US007597478B2

(12) United States Patent
Pruchnicki et al.

(10) Patent No.: US 7,597,478 B2
(45) Date of Patent: Oct. 6, 2009

(54) INSULATED BAG WITH LIFTING APPARATUS

(75) Inventors: Renia Pruchnicki, Toronto (CA); Melvin S. Mogil, Toronto (CA)

(73) Assignee: California Innovations Inc. (CA)

( * ) Notice: Subject to any disclaimer, the term of this patent is extended or adjusted under 35 U.S.C. 154(b) by 378 days.

(21) Appl. No.: 11/440,776

(22) Filed: May 25, 2006

(65) Prior Publication Data

US 2007/0274613 A1 Nov. 29, 2007

(51) Int. Cl.

| | |
|---|---|
| ***B65D 30/22*** | (2006.01) |
| ***B65D 33/06*** | (2006.01) |
| ***B65D 33/16*** | (2006.01) |
| ***B65D 33/04*** | (2006.01) |
| ***B65D 81/38*** | (2006.01) |
| ***B65D 33/02*** | (2006.01) |
| ***B65D 30/00*** | (2006.01) |
| ***A45C 15/00*** | (2006.01) |

(52) U.S. Cl. ..... 383/40; 383/16; 383/66; 383/106; 383/110; 383/119; 383/121.1; 224/578

(58) Field of Classification Search ..... 383/110, 383/2, 6, 4, 16, 40, 66, 106, 119, 121.1; 224/578, 224/579

See application file for complete search history.

(56) References Cited

U.S. PATENT DOCUMENTS

| | | | | |
|---|---|---|---|---|
| 2,745,524 | A * | 5/1956 | Plotkin | 190/115 |
| 3,019,952 | A * | 2/1962 | Brewster | 383/6 |
| 3,802,613 | A * | 4/1974 | Droeger | 224/153 |
| 4,273,274 | A * | 6/1981 | Freistadt | 383/6 |
| 4,578,814 | A * | 3/1986 | Skamser | 383/6 |
| 4,679,671 | A * | 7/1987 | Kobayashi | 190/115 |
| 4,802,233 | A * | 1/1989 | Skamser | 383/15 |
| 4,805,776 | A * | 2/1989 | Namgyal et al. | 206/523 |
| 4,810,102 | A * | 3/1989 | Norton | 383/4 |
| 4,812,054 | A * | 3/1989 | Kirkendall | 383/110 |
| 5,007,250 | A * | 4/1991 | Musielak | 383/66 |
| 5,892,202 | A * | 4/1999 | Baldwin et al. | 219/387 |
| 5,957,354 | A * | 9/1999 | Mentken | 224/614 |
| 6,390,345 | B1 * | 5/2002 | Brown et al. | 224/578 |
| 6,471,105 | B1 * | 10/2002 | Ammerman et al. | 224/625 |
| 2004/0136621 | A1 * | 7/2004 | Mogil | 383/110 |

* cited by examiner

*Primary Examiner*—Jes F Pascua
(74) *Attorney, Agent, or Firm*—Ostrolenk Faber LLP

(57) ABSTRACT

A soft sided insulated cooler bag has a base and side panels. The base includes a rigid or semi-rigid reinforcement or batten that serve to provide a relatively hard or stiff edge about which the bag can be panel folded over on itself. The upper edge of the bag has a length that is as great as half the periphery of the bottom panel. The bag can be collapsed to a flat position and then panel folded to a storage position. Retainers are provided to keep the bag in the storage position. The bag has lifting apparatus, which may be strap. The straps may be anchored to the bag at a plurality of anchor points, some of which may be sliding keepers, such that the handle can be moved to a first position in which the bag may be held in a predominantly up-and-down orientation, and to a second position in which the bag may be held in a predominantly flat or horizontal position.

20 Claims, 27 Drawing Sheets

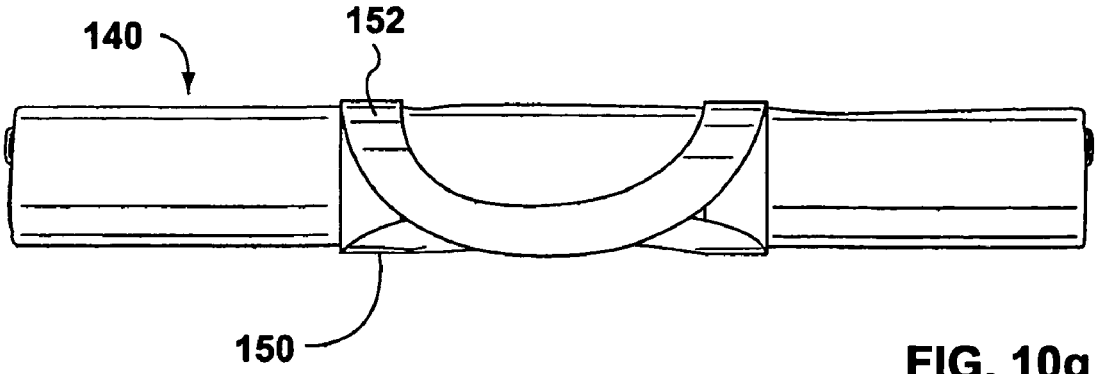
FIG. 10g
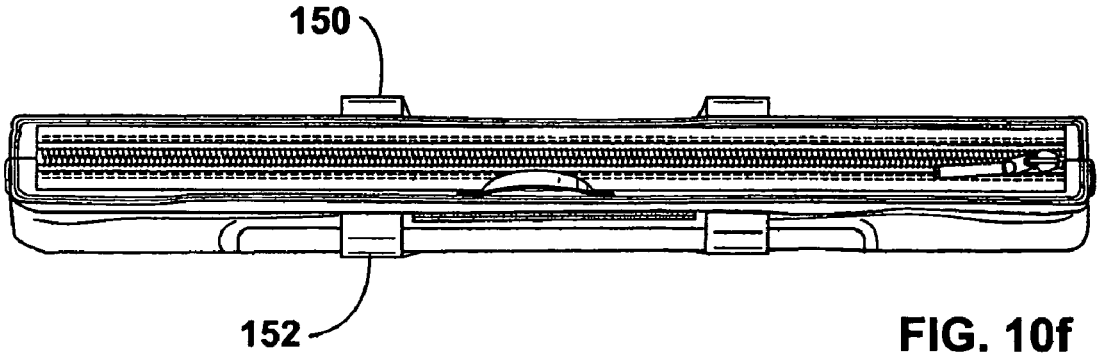
FIG. 10f
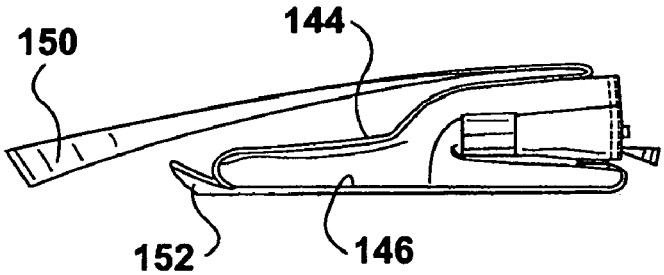
FIG. 10e
FIG. 10d
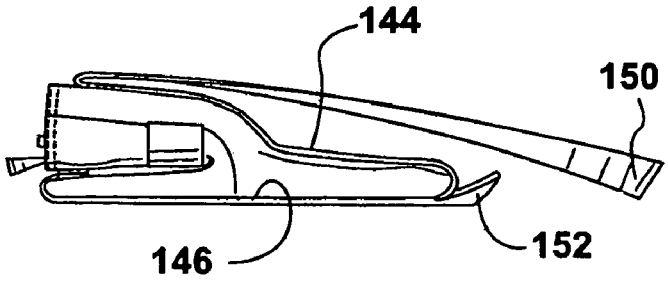

INSULATED BAG WITH LIFTING APPARATUS

FIELD OF INVENTION

This invention relates to the field of insulated containers.

BACKGROUND OF THE INVENTION

Soft sided insulated containers have been known for some years. They are typically used as containers for carrying chilled food or beverage items, but can also be used to keep foods or beverages warm or hot.

Certain sizes and shapes of coolers are better for some purposes than others. It may be that one type of insulated bag may be of particular use in the transportation of hot or cold substantially planar items, that is, items whose width and breadth is of significantly greater magnitude than their through-thickness. An example of such an item might be a pizza box. That same bag might be desired for use with other items, or as a general thermally insulated bag for use in carrying cooled objects home from the grocery store, for example. Some goods may tend to be suitable for carriage in a generally upright orientation, or may be indifferent to orientation, or may rely upon the bag itself to retain a number of loose items that might otherwise scatter. For example, it may be that tins of juice concentrate may be carried at the bottom of a bag, with the handles, and the opening of the bag, uppermost. A pizza, by contrast, might be an example of a good that may not travel overly well if the pizza box is tipped up on one edge. It may travel better if kept in a generally flat, or level, or predominantly horizontal orientation. Also, with a pizza, the opening of the bag may tend to be along one of the thickness edges, so that the pizza slides in and out of the bag in a generally flat orientation along one of the relatively narrow side edges. It may also be that a bag of the size and shape to carry a pizza, may be somewhat cumbersome and inconveniently shaped for storage when empty.

It may be that a carrying handle that is suitable for using such a bag in a predominantly upright or vertical orientation, may not be as suited as it might be for carrying the bag in a horizontal orientation. Similarly, a handle that may be suited to carrying the bag in a generally flat condition may not perhaps serve as well as might be desired in the predominantly upright condition.

SUMMARY OF THE INVENTION

In an aspect of the invention, there is a foldable bag having an insulated wall structure. The bag has a pair of strap handles by which it may be carried in a predominantly up and down orientation. One of the strap handles may be re-positionable to permit said bag to be carried in a predominantly horizontal orientation.

In another aspect of the invention, there is an insulated bag having an insulated wall structure, the wall structure having a width, a depth, and a thickness. The width and depth may each be more than double the thickness. The bag may have opposed sidewall portions that are extensive in directions corresponding to the width and depth. The bag has a handle that is movable between a first position in which the bag hangs in a predominantly up- and down orientation when suspended by the handle, and a second position in which the bag hangs predominantly cross-wise when suspended from the handle.

In another feature the wall structure includes a sidewall panel, the side wall panel having a centroid, and the strap handle is retained by an array of retainers, at least one of the retainers permitting at least one degree of motion of the at least a portion of the strap handle relative to the sidewall panel, and the array of retainers defining vertices of a polygon, the centroid falling within the polygon. In a further feature, the strap handle is secured to the wall structure at a plurality of retention points, one of the retention points being defined by a keeper that permits sliding of at least a portion of the strap handle relative thereto. In yet another feature, the first position, a bight is formed in the strap handle to one side of the keeper, and in the second position, a bight is formed in the strap handle to another side of the keeper. In still yet another feature the strap handle is secured to the wall structure at a plurality of retention points, two of the retention points being defined by respective first and second keepers each of which permits sliding of at least a portion of the strap handle relative thereto. In a further additional feature, in the first position a bight is formed in the strap handle between the first and second keepers, and in the second position a bight is formed elsewhere than between the first and second keepers. In a still further feature, in the second position, a first bight is formed in the strap handle between the first keeper and a retention point other than that defined by the second keeper, and a second bight is formed between the second keeper and a retention point other than that defined by the first keeper. In a yet still further feature, the strap handle has a running length, the first ad second bights have apices, and the length is great enough that the apices are movable to contact each other, whereby a person lifting the bag may hold both of the bights in one hand. In still yet another further feature, the sidewall structure has a largest side, the largest side has a centroid, and the plurality of retention points define a footprint that straddles the centroid.

In another feature of that aspect of the invention, the wall structure includes a sidewall panel, the sidewall panel having at least a first margin, and a closure member running along at least a portion of that first margin. The strap handle is restrained at first and second retention points on the sidewall panel distant from the first margin, and at third and fourth retention points on the sidewall panel more proximate to the first margin. The strap handle having a flexible member running from the first retention point to the third retention point, from the third retention point to the fourth retention point, and from the fourth retention point to the second retention point. In the first position the strap handle has a bight located between the third and fourth retention points, the bight being of size to extend beyond the first margin. In the second position the strap handle has a bight located between at least one of (a) the first retention point and the third retention point; and (b) the second retention point and the fourth retention point.

In another feature the third and fourth retention points are keepers and the strap handle is at least partially slidable with respect thereto. In still another feature, the strap handle has first and second portions mounted in spaced apart relationship on the wall structure, there is an accommodation formed between the portions, and the accommodation has a transparent face panel.

In another aspect of the invention, there is a foldable insulated bag. The bag has an insulated wall structure, defining an insulated space therewithin. The wall structure has a closure member operable to govern access to the insulated space. The wall structure includes a forming panel. The wall structure, when empty, is movable to a first, flattened position. The wall structure is foldable about at least a portion of the forming panel to a folded storage position. At least a first handle member mounted to the wall structure. The handle member has first and second ends attached to the wall structure. First and second keepers are mounted to the wall structure. The handle member is slidable with respect to the first and second keepers, and is threaded through the first and second keepers. The handle has a first region between the first end and the first keeper, a second region between the second end and the second keeper, and a third region between the first and the second keepers. The handle member being movable to form a bight in the third region from which the bag is suspendable in a predominantly up-and-down orientation. The handle member being movable to form bights in the first and second regions. The bag is suspendable therefrom in a predominantly cross-wise orientation.

In another aspect, there is an insulated bag having an insulated sidewall, and a bail attached to the insulated sidewall. The sidewall has a first margin portion and a generally opposed second margin portion. A first portion of the bail is retained at a first retention location in a region closer to the first margin than to the second margin. A second portion of the bail is retained at a second retention location closer to the second margin than to the first margin. The handle is movable to a first position wherein, in use, the bag is suspended from a location of suspension and the first retention location is between the location of suspension and the second retention location. The handle is movable to a second retention position in which, in use, the bag is suspended from a second location of suspension, the second location of suspension being between the first and second retention locations.

In a further aspect of the invention, there is a bag having an insulated sidewall and a first handle mounted to the sidewall. The handle has first and second ends attached to the sidewall, and first and second keepers through which the handle is fed, such that the handle has a first region between the first end and the first keeper, a second region between the second end and the second keeper, and a third region between the first and the second keepers. The handle is movable to a first position in which the bag is suspendable from the third region in a predominantly up-and-down orientation, and is suspendable from at least one of the first and second regions in a predominantly cross-wise orientation.

In still yet a further additional feature, the sidewall structure includes first and second opposed sidewall panels. Each side wall panel has a first edge adjoining the base panel and a second edge distant therefrom. The closure member is mounted to the distant edges.

In another additional feature, the sidewall structure includes first and second opposed sidewall panels. Each side wall panel has a first edge adjoining the base panel and a second edge distant therefrom. The side wall panels have an altitude measured between the first and second edges, and the base panel has a width measured between junctures of the adjoining edges of the sidewall panels therewith. The altitude has a magnitude X, and the width has a magnitude Y wherein X has a value lying on one of the ranges chosen from the set of ranges consisting of (a) 0.8 Y to 1.2 Y; (b) 1.8 Y to 2.2 Y; and (c) 2.8 Y to 3.2 Y.

In still another additional feature, the foldable insulated bag has a retainer operable to secure the foldable insulated bag in the folded storage position. The sidewall structure includes first and second opposed sidewall panels. Each sidewall panel has a first edge adjoining the base panel and a second edge distant therefrom. The base panel has a first edge connected to the first sidewall panel, and a second edge connected to the second sidewall panel. The base panel has an outer face, and an inward face. In the flattened position the inward face of the base panel is oriented to face toward the second sidewall panel. In the flattened position the second edge of the base panel lies nearer than the first edge of the base panel to the second edge of the first sidewall panel. The outward face of the base panel has a first member of the retainer mounted thereto adjacent to the second edge thereof. The first sidewall panel has a second member of the retainer mounted adjacent to the second edge thereof. The base panel is movable to bring the first portion of the retainer into mating engagement with the second portion of the retainer. In yet another additional feature, the first and second portions of the retainer are mating hook-and-eye fabric strip portions.

In still yet another additional feature, the sidewall structure includes first and second opposed sidewall panels. Each sidewall panel has a first edge adjoining the base panel and a second edge distant therefrom. The base panel has a periphery. The periphery includes a first edge adjoining the first edge of the first sidewall panel, and a second edge adjoining the first edge of the second sidewall panel. The periphery includes two opposed remainder portions between the first and second sides. The portions have lengths $2a_1$ and $2a_2$ respectively. The first edge of the first sidewall panel has a length, L. The first edge of the base panel has a length 'b'. The length L is at least as great as $b+(a_1+a_2)$.

In a further additional feature, the first edge of the first sidewall panel is centered relative to the first edge of the base panel. In yet a further additional feature, the sidewall structure includes first and second opposed sidewall panels. Each sidewall panel has a first edge adjoining the base panel and a second edge distant therefrom. The base panel is rectangular, having two opposed sides of length 'b' and two opposed sides of length 'a'. The first edge of the first sidewall panel has a length, L. The length L is at least as great as b+2a. In still a further additional feature, the first edge of the first sidewall panel is centered relative to the first edge of the base panel.

In still yet a further additional feature, the sidewall structure includes equal sized first and second opposed sidewall panels. Each side wall panel has a first edge adjoining the base panel and a second edge distant therefrom. In another additional feature, the first edges of the first and second sidewall panels have a length $L_1$, and the second edges of the sidewall panels have a length $L_2$, where $L_2$ is at least as great as $L_1$. In still another additional feature, each of the sidewall panels has a second edge distant from the first edge thereof. The second edges of the sidewall panels are each longer than the base panel.

In yet another additional feature, the sidewall structure includes a pair of opposed first and second sidewall panels. The first and second sidewall panels each includes a first edge mounted to the base panel, a second edge opposed to and distant from the second edge, a third edge, and a fourth edge. The fourth edge is opposed to the third edge. The respective third edges are mutually attached. The respective fourth edges are mutually attached. In another additional feature, the insulated bag includes a waterproof liner. In a further additional feature, the insulated bag includes reflective interior surface oriented to face toward objects placed in the insulated space.

In another aspect of the invention, there is a foldable insulated bag comprising a first side panel, a second side panel, and a base panel. At least the first side panel and the second side panel is insulated. At least the first side panel and the second side panel is pliable. The first side panel, the second side panel and the base panel co-operate to define an enclosed, insulated space. The first side panel has a first base edge adjoining the base panel. The second side panel has a second base edge adjoining the base panel. The first side panel has a first distal edge opposite to the first base edge. The second side panel has a second distal edge opposite to the second base edge. At least a portion of the first distal edge is movable relative to at least a portion of the second distal edge to permit access to the enclosed insulated space. A closure member is mounted to govern access to the enclosed, insulated space. The base panel has a length and a width, the length being greater than the width. The distal edge of the first side panel is longer than the base panel.

These and other aspects of the invention may be more readily understood with the aid of the illustrative Figures and detailed description included hereinbelow.

BRIEF DESCRIPTION OF THE DRAWINGS

In the illustrative Figures of an example, or examples, embodying the various aspects of the invention, provided by way of illustration, but not of limitation of the present invention:

FIG. 10*d* shows a left hand end view of the insulated bag of FIG. 10*a;*

FIG. 10*e* shows a right hand end view of the insulated bag of FIG. 10*a;*

FIG. 10*f* shows a top view of the insulated bag of FIG. 10*a;*

FIG. 10*g* shows a bottom view of the insulated bag of FIG. 10*a;*

DETAILED DESCRIPTION

Figure 1:
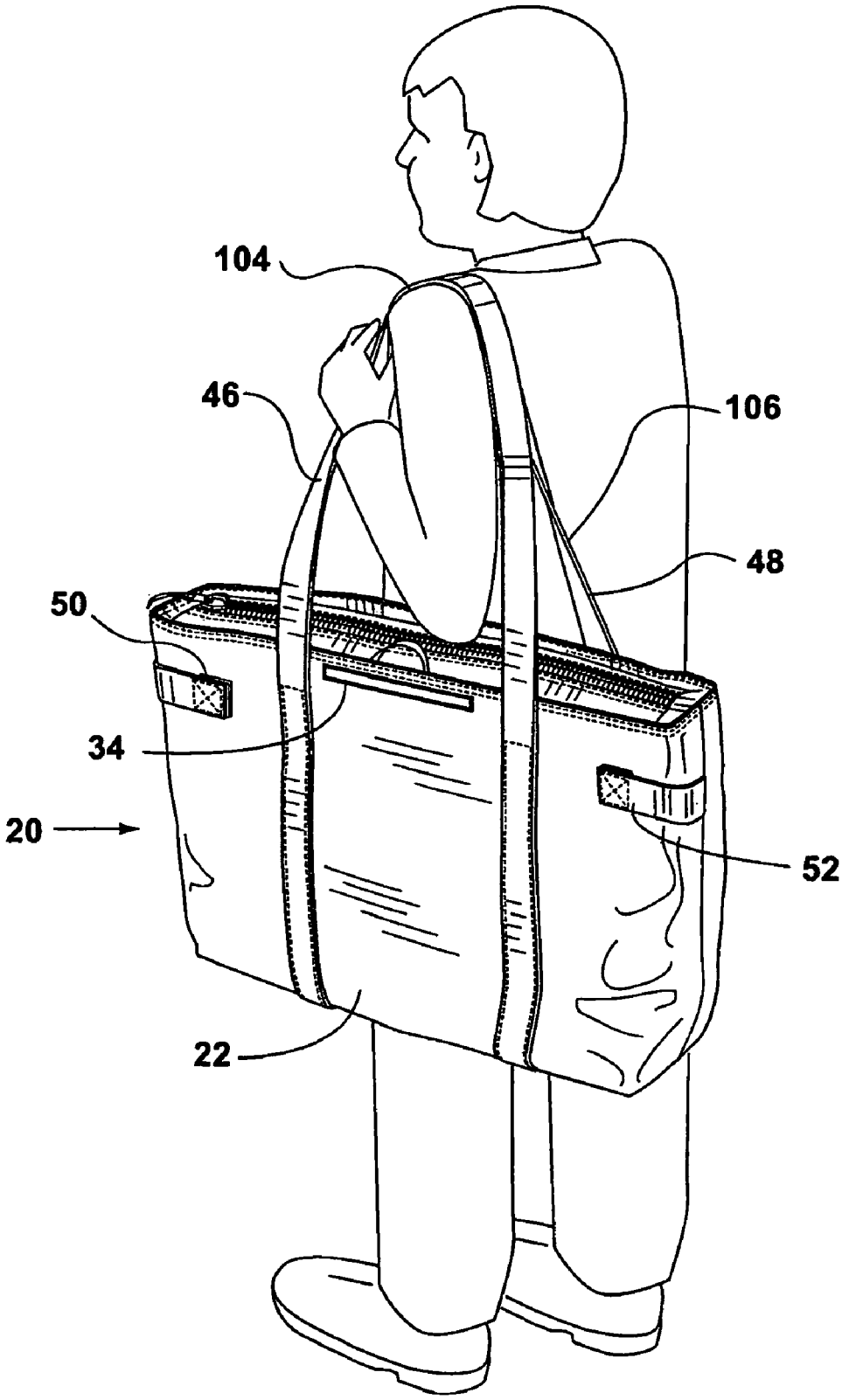
FIG. 1 shows a perspective view of an example of a foldable insulated bag of an embodiment of the present invention as carried by a user.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

For the purposes of this description, the largest panels of the bags herein described are arbitrarily designated as the front and rear sides, faces, or portions of the bag. Similarly, the closure member, or opening of the bag is arbitrarily designated as being at the top, and the base panel is designated as being at the bottom. It should also be understood that, within the normal range of temperatures to which human food and human touch is accustomed, although the term cooler, or cooler container, or cooler bag, may be used, such insulated structures may generally also be used to keep food, beverages, or other objects either warm or hot as well as cool, cold, or frozen.

In this specification reference is made to insulated containers. The adjective "insulated" is intended to be given its usual and normal meaning as understood by persons skilled in the art. It is not intended to encompass single layers, or skins, of conventional webbing materials, such as Nylon™, woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. Following from *Phillips v. AWH Corp.*, this definition provided in the specification is intended to supplant any dictionary definition, and to prevent interpretation in the patent office that strays from the customary and ordinary meaning of the term "insulated" as provided herein.

As seen in the Figures, an example of a portable, collapsible soft sided, insulated wall structure is identified as a foldable cooler tote bag 20. This structure can be referred to as an insulated bag, an insulated container, a cooler, or such like. The basic structure of bag 20 includes a first side panel, or wall, or sidewall, arbitrarily designated front panel 22, a second side panel, or wall, or sidewall, designated arbitrarily as rear panel 24, and a third panel or wall identified as a bottom, or base panel 26. As described more fully below, these panels are joined together to form a pouch, or bag, having an enclosed internal space 25 surrounded by insulated walls. The enclosed volume of internal space 25 varies with the condition of the bag. That is, while the bag is in a folded (that is, collapsed) condition or position, or is lying flat, the internal volume is negligibly small, if not zero. However, when bag 20 is in an unfolded condition, or expanded position, it may tend to take on a shape to accommodate objects placed within the internal space, and it may assume a suitably capacious internal volume.

When bag 20 is in use, access to the internal volume, namely internal space 25 thereof, is governed by a closure member 28. In the illustrated example, closure member 28 may be a linear tracked closure device in the nature of a zipper assembly 30 mounted between the upper margins of the side wall panels, namely front and rear panels 22 and 24. Other kinds of closures could be used such as a Velcro™ hook-and-eye fabric closure, a series of spaced apart snaps, a continuous mating plastic tongue and groove or other device. A relatively robust zipper assembly is preferred, as it may tend to provide a simple, quick, and relatively strong closure. While bag 20 can be made water-tight by other means, it is preferred to provide a liner 32 that can be either sewn in place, or may be removable, or it may be wholly or partially invertible. A liner that is at least partially invertible, or removable, is preferred, since this may facilitate washing.

Figure 6A:
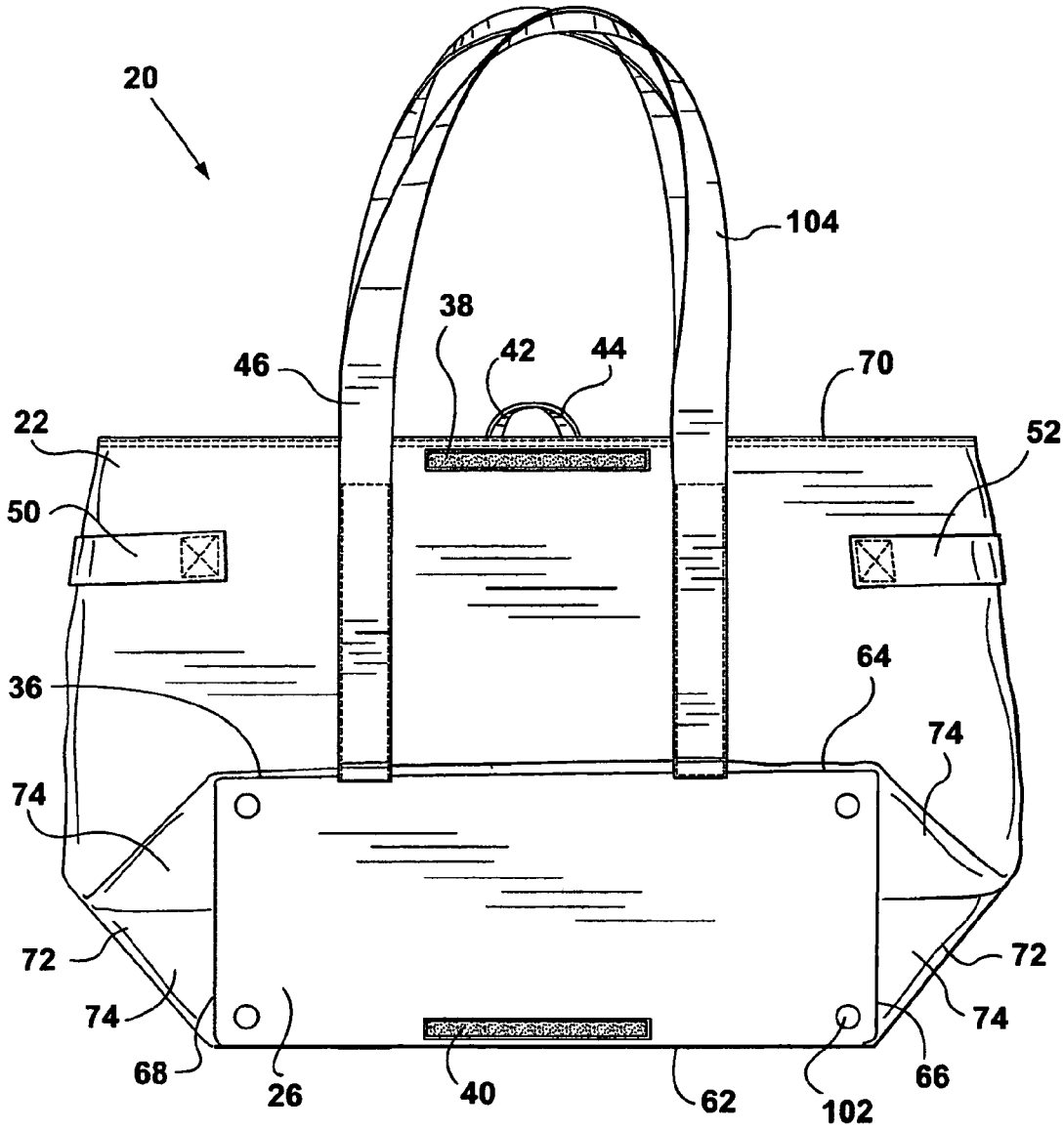
FIG. 6*a* shows a front view of the bag of FIG. 1 in a partially folded condition.
Figure 6B:
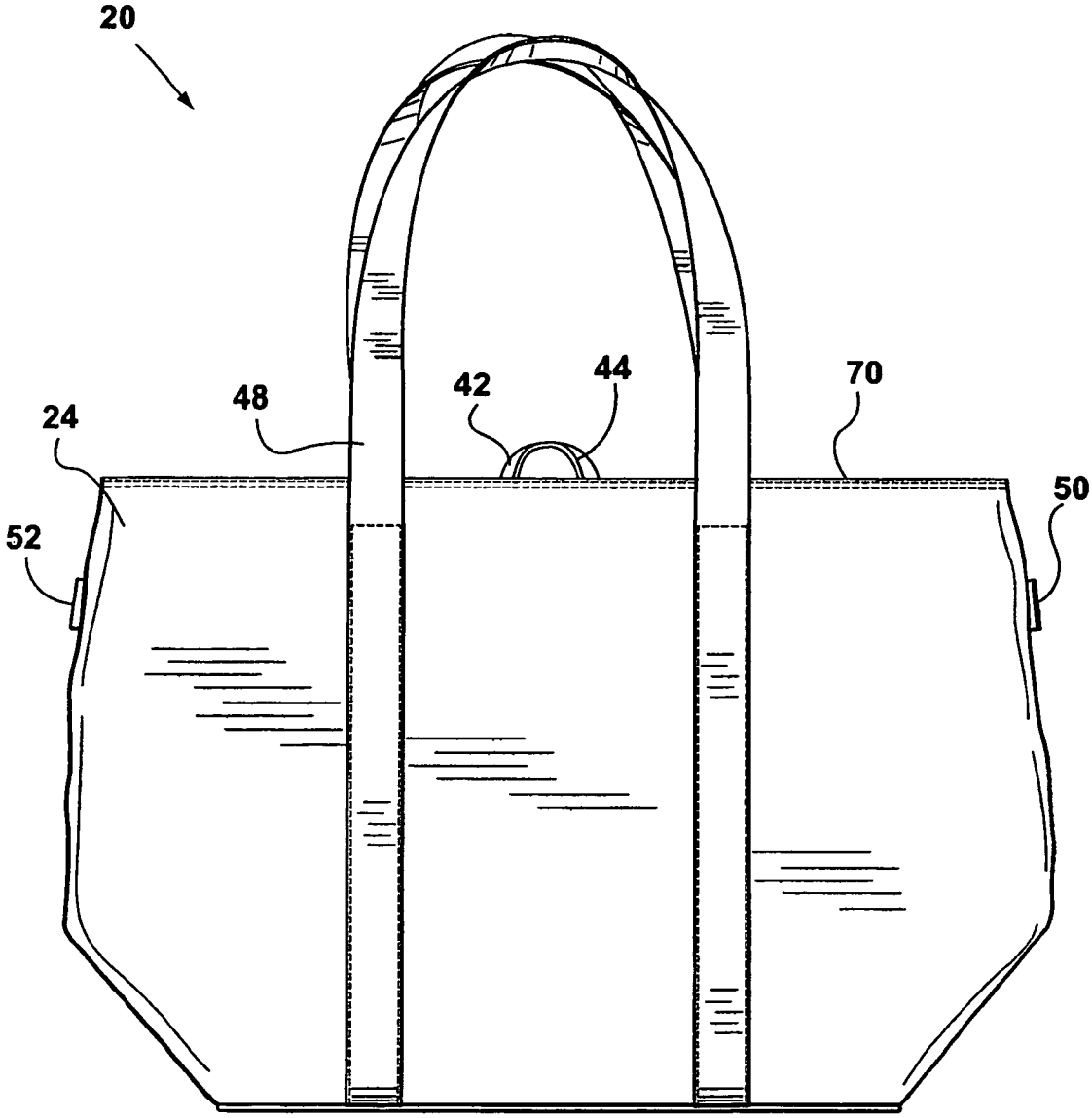
FIG. 6*b* shows a rear view of the bag of FIG. 6*a;*
Figure 6D:
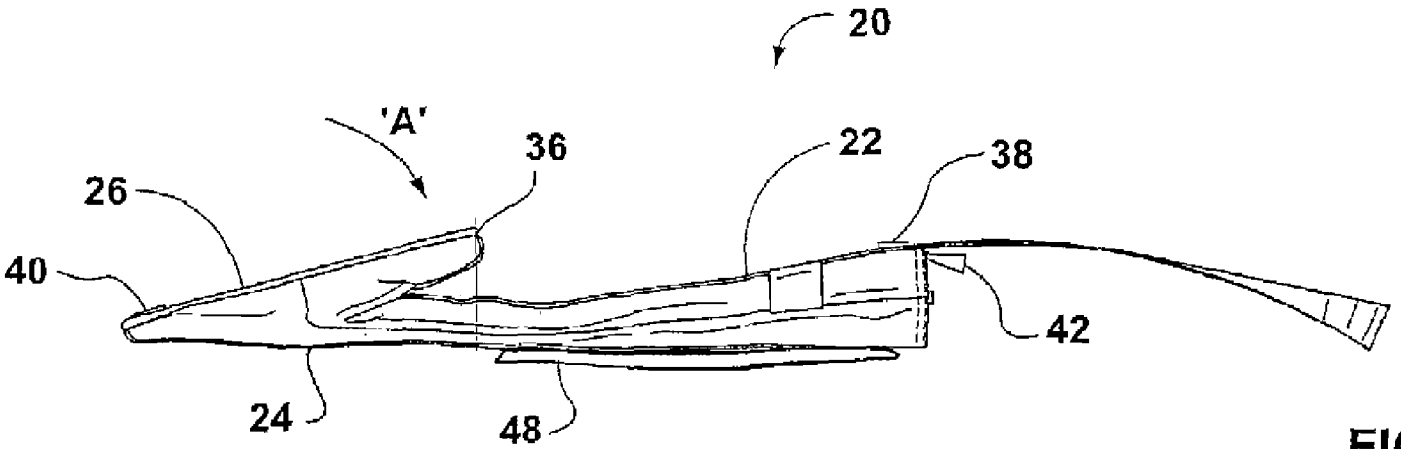
FIG. 6*d* shows a right handed view of the bag of FIG. 6*a;*
Figure 6C:
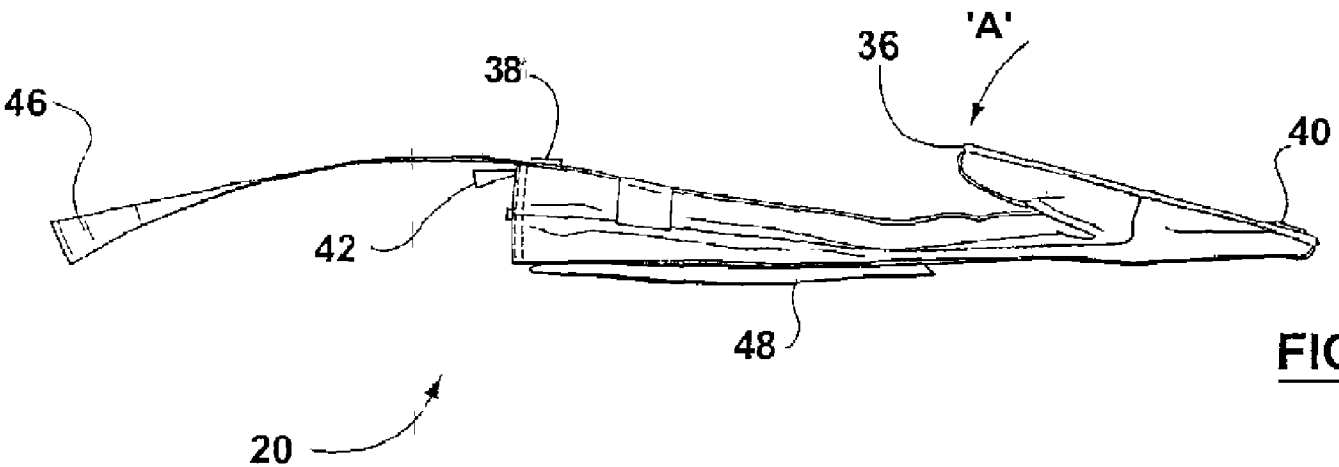
FIG. 6*c* shows a left hand end view of the bag of FIG. 6*a;*

When the bag is not in use, it may tend to be readily foldable. First, the bag is collapsed by lying it flat and folding front sidewall panel 22 near its bottom margin such that base panel 26 lays in a more or less flat orientation relative to the rear sidewall panel, 24, as seen in FIGS. 6*a* and 6*b*. In this, collapsed, generally flattened, position, the upward edge 36 of base panel 26 (namely the edge that is folded toward front sidewall panel 22 and hence toward what would normally be the upper parts of bag 20 generally) acts as a former, or form, for bending the body of bag 20 to define a first fold by rotating the folded part of the bag in the direction of arrow 'A' (counter-clockwise in the Figures, but arbitrary since it would be clockwise if viewed from the other direction, and bag 20 can be made with either a left handed or right handed fold). This permits one portion of bag 20 to fold over on another portion, in the manner of folding a page over on itself.

Figure 3A:
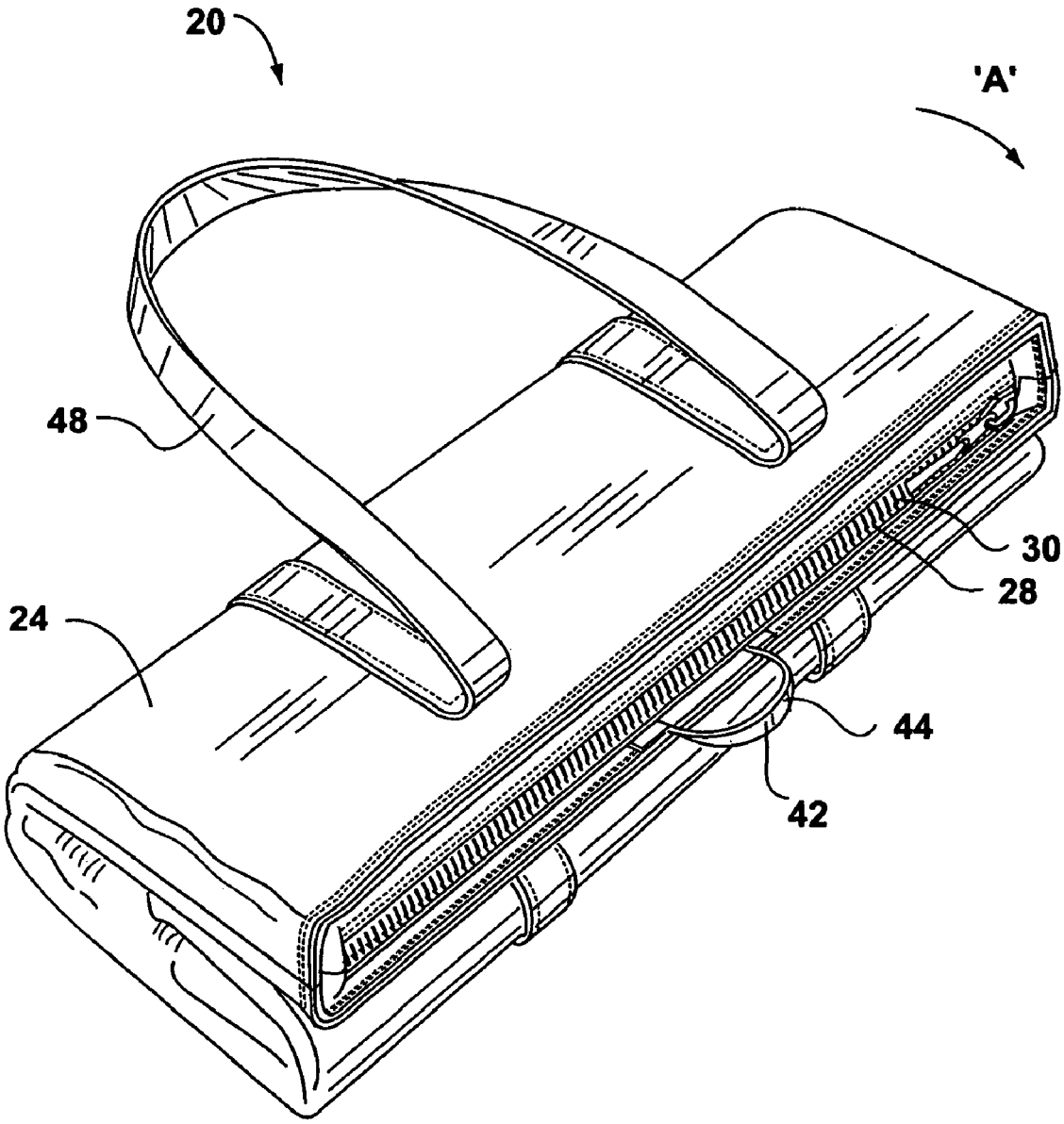
FIG. 3*a* shows a perspective view of the bag of FIG. 1 as folded.
Figure 3C:
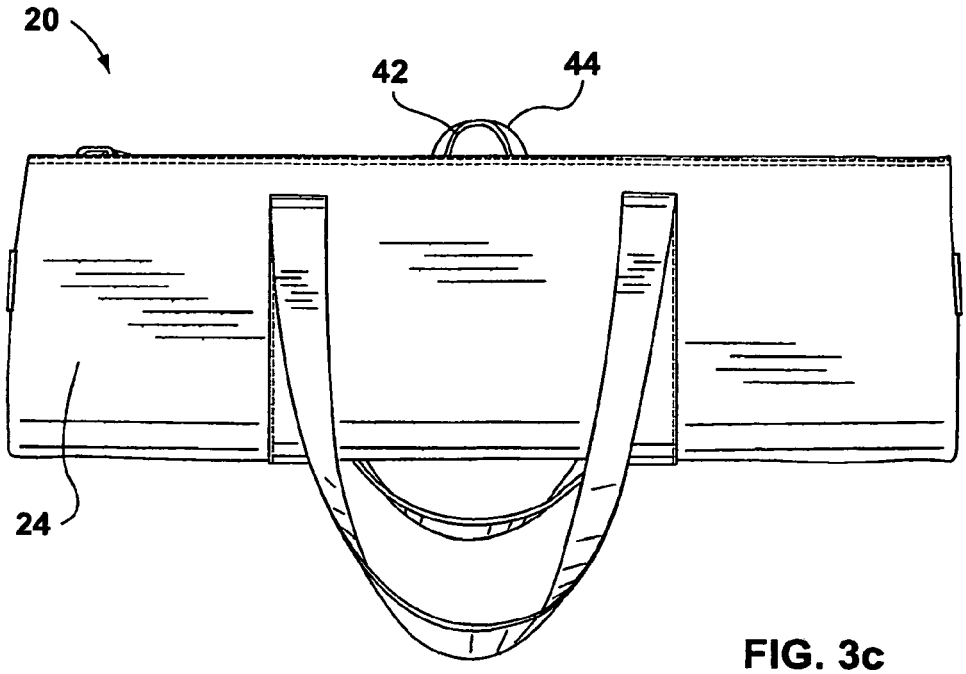
FIG. 3*c* shows a rear view of the bag of FIG. 3*a* in the fully folded condition.
Figure 3B:
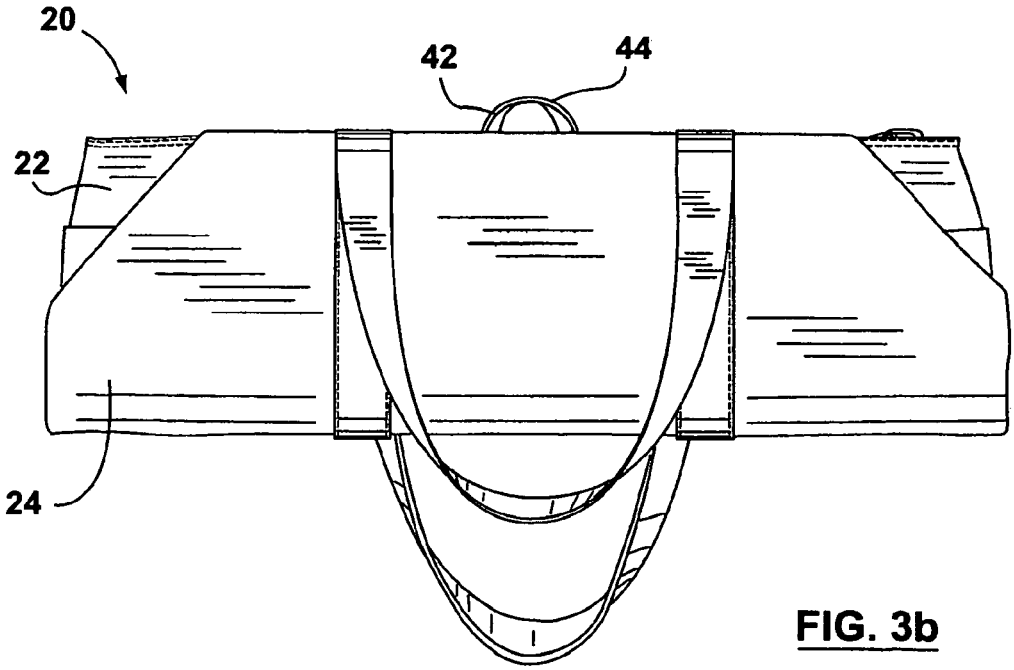
FIG. 3*b* shows a front view of the bag of FIG. 3*a* in a fully folded condition.
Figure 3G:
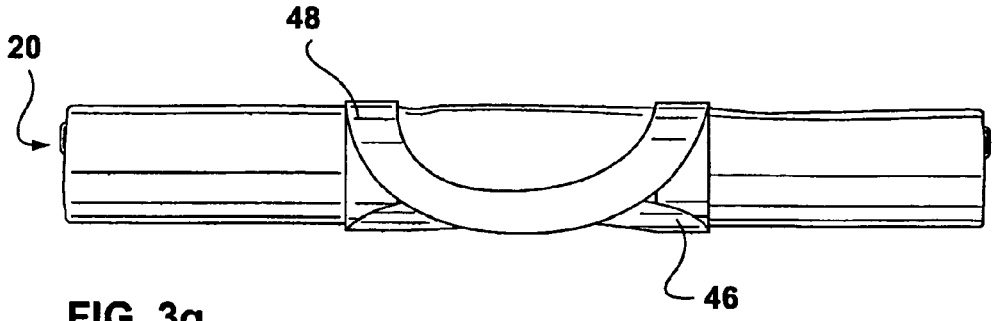
FIG. 3*g* shows a bottom view of the bag of FIG. 3*a* in the fully folded condition.
Figure 3F:
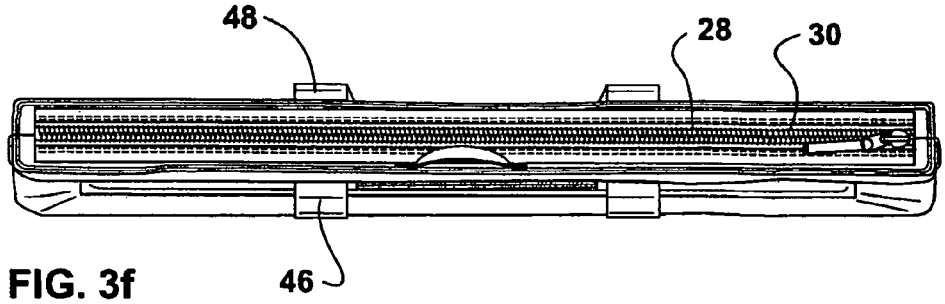
FIG. 3*f* shows a top view of the bag of FIG. 3*a* in the fully folded condition.
Figure 3E:
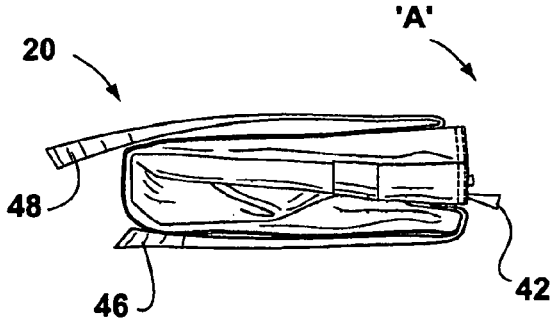
FIG. 3*e* shows a right hand end view of the bag of FIG. 3*a* in the fully folded condition.
Figure 3D:
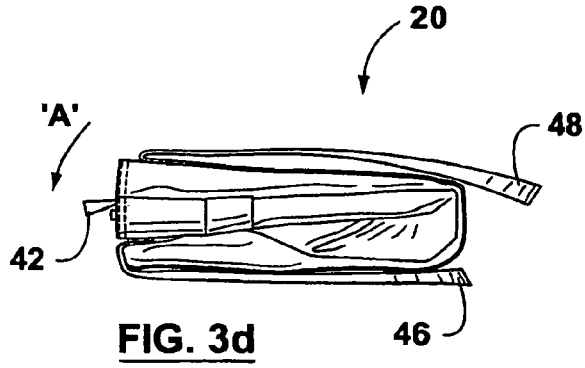
FIG. 3*d* shows a left hand end view of the bag of FIG. 3*a* in the fully folded condition.
Figure 3H:
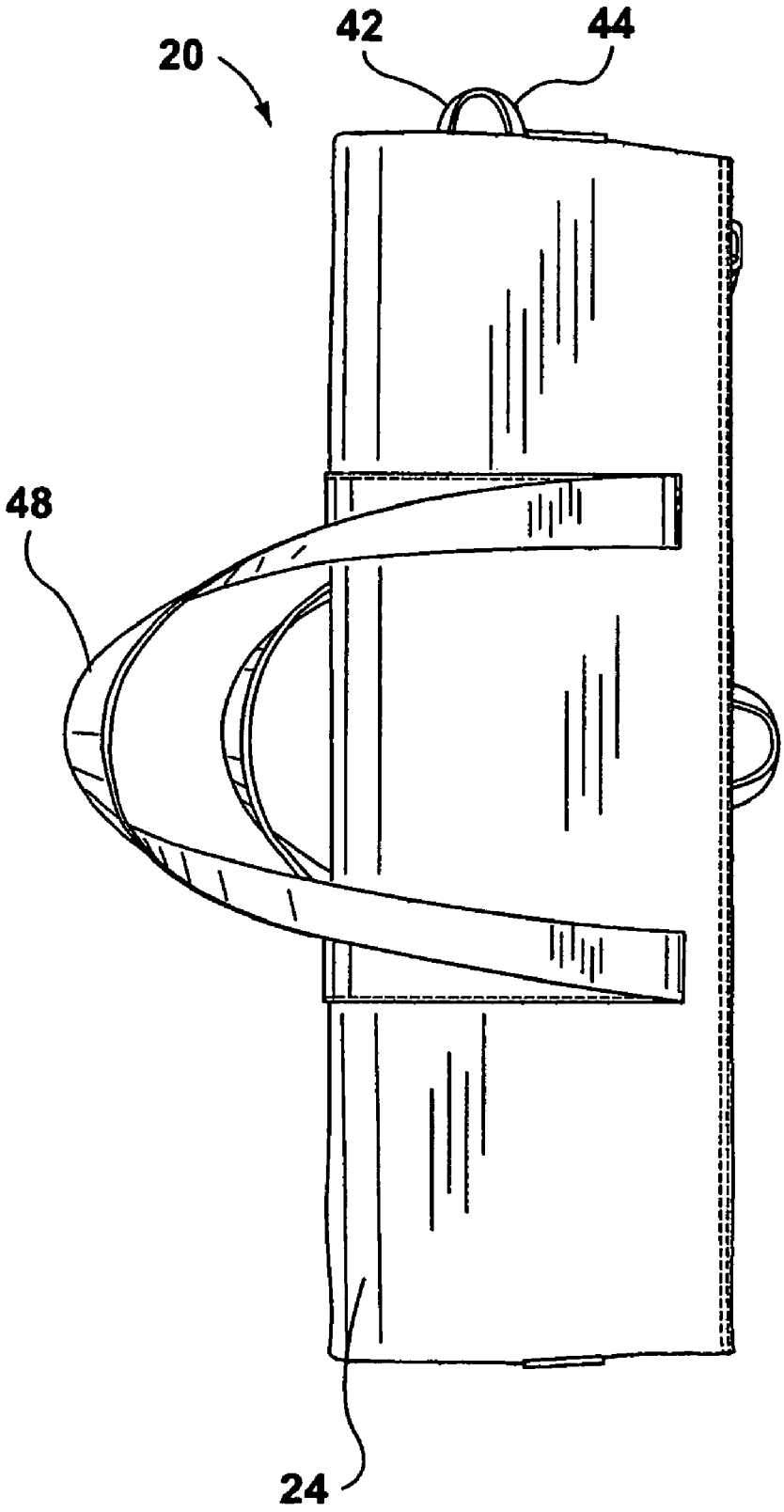
FIG. 3*h* shows the bag of FIG. 3*c* with an alternate hang loop orientation.
Figure 4A:
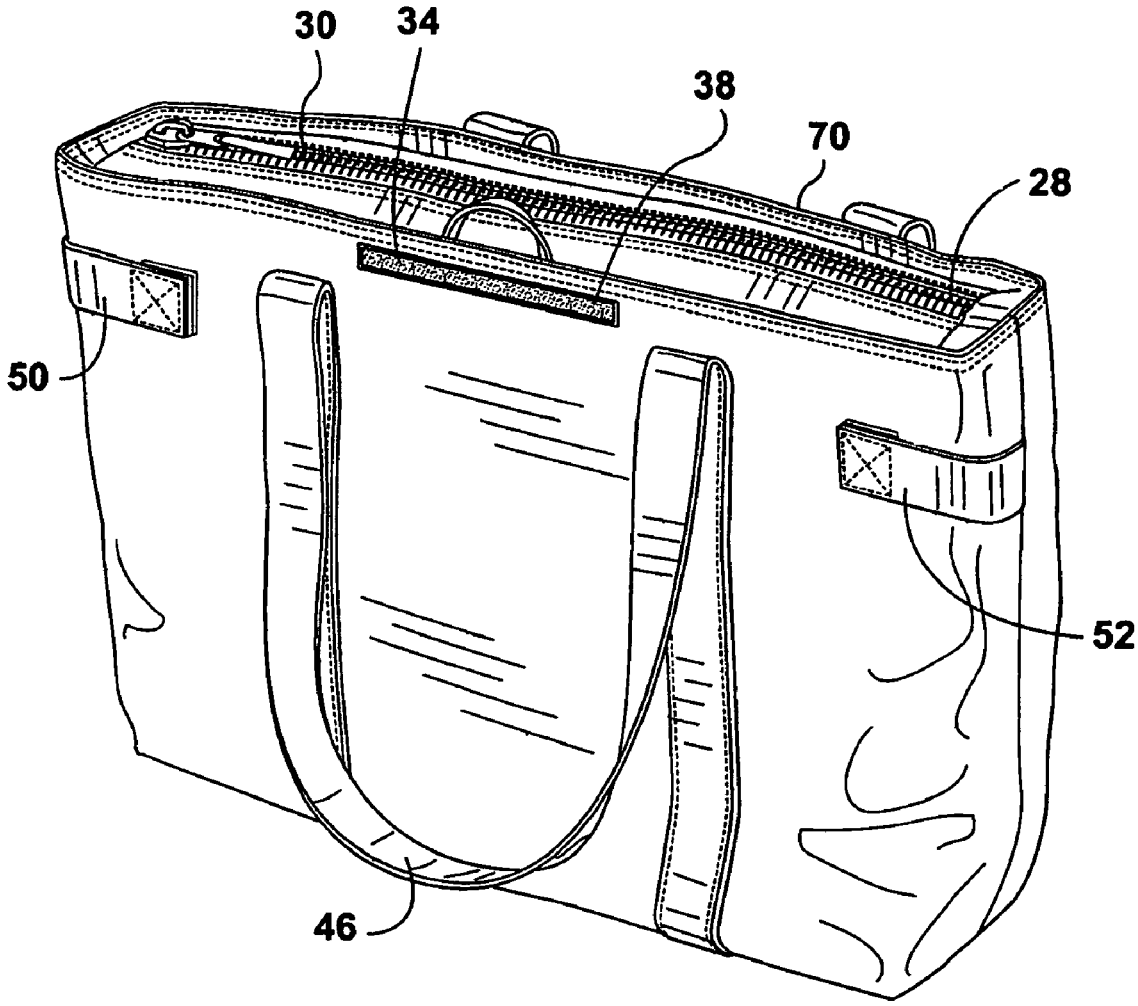
FIG. 4*a* shows a perspective view of the unfolded bag of FIG. 1.
Figure 4C:
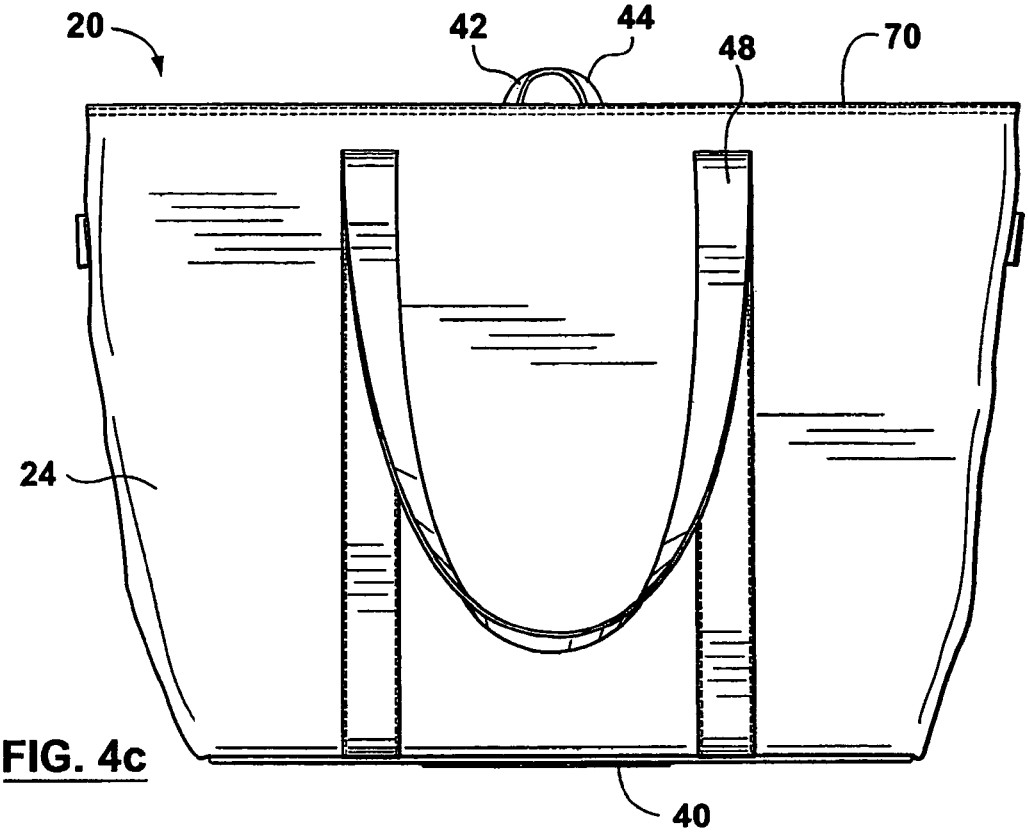
FIG. 4*c* shows a rear view of the bag of FIG. 4*a* in the fully unfolded condition.
Figure 4B:
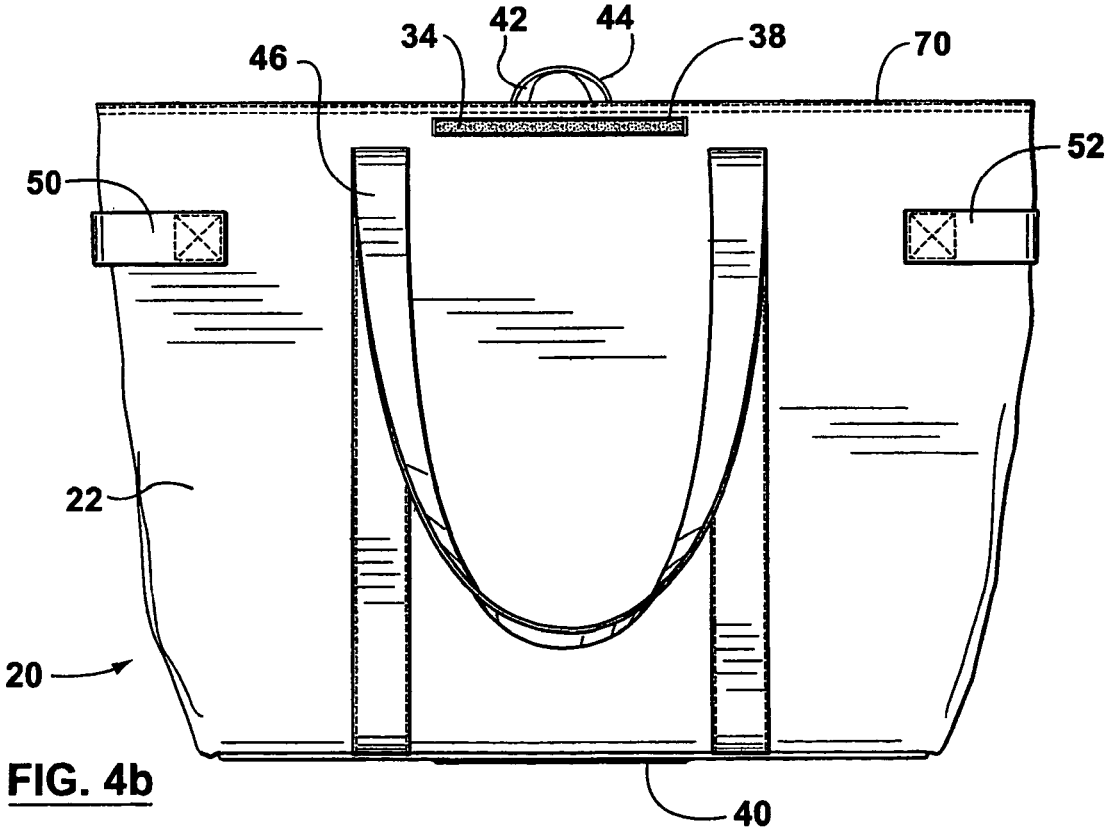
FIG. 4*b* shows a front view of the bag of FIG. 4*a* in a fully unfolded condition.
Figure 4E:
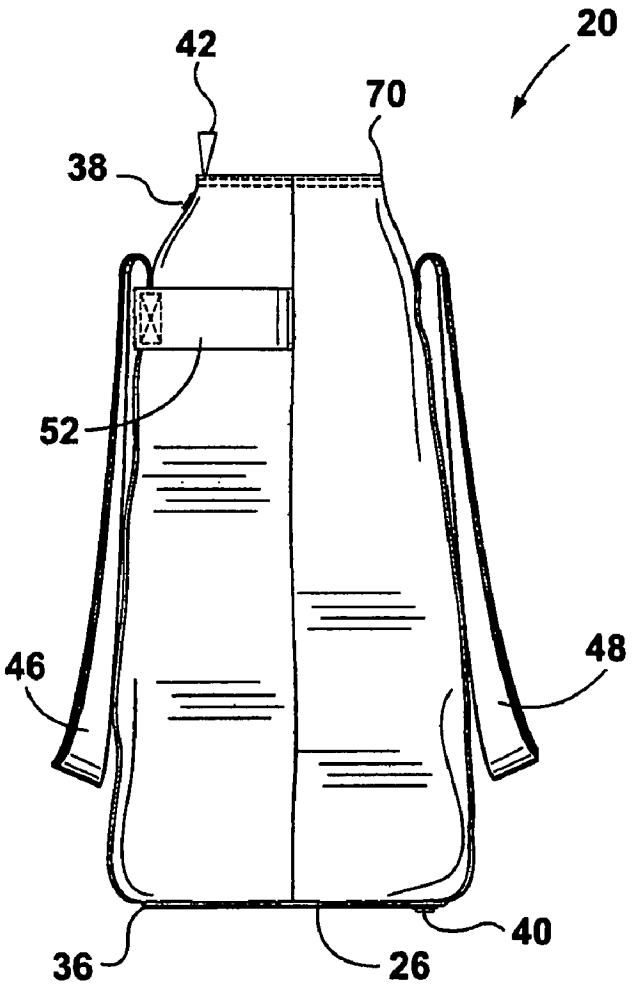
FIG. 4*e* shows a right hand end view of the bag of FIG. 4*a* in the fully unfolded condition.
Figure 4D:
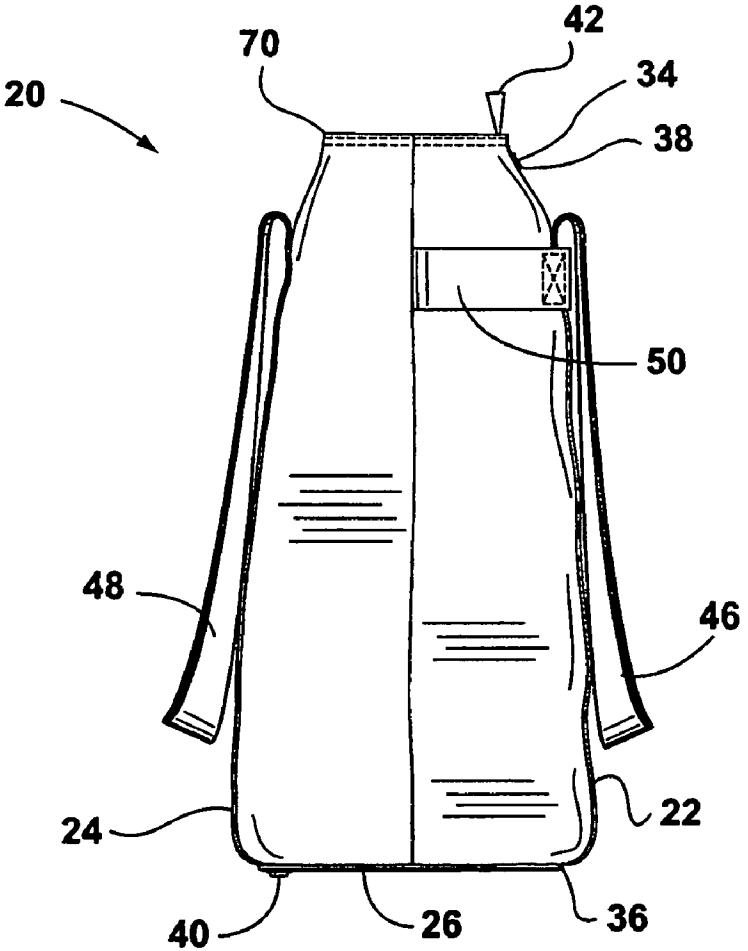
FIG. 4*d* shows a left hand end view of the bag of FIG. 4*a* in the fully unfolded condition.
Figure 4F:
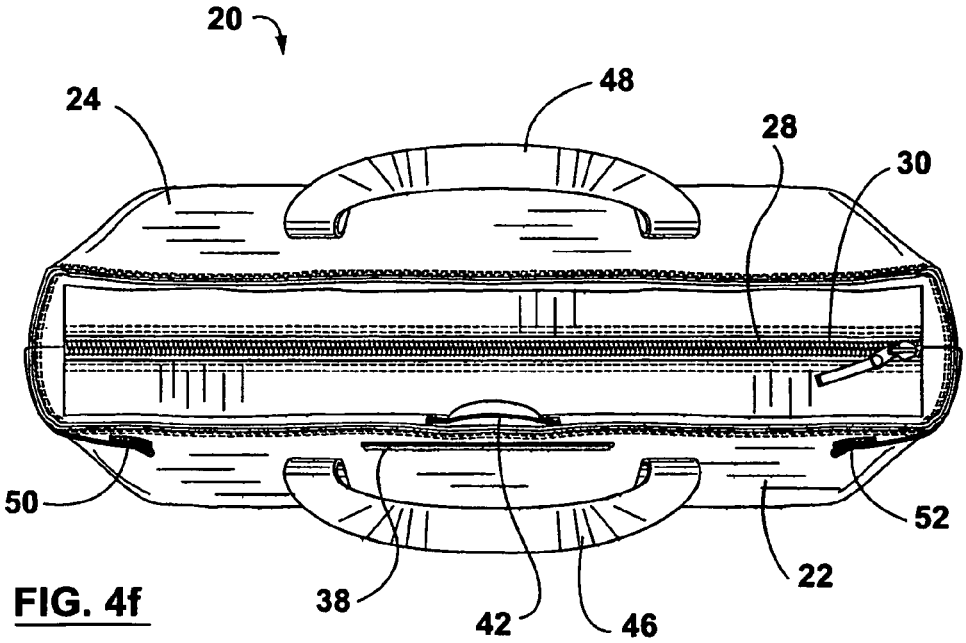
FIG. 4*f* shows a top view of the bag of FIG. 4*a* in the fully unfolded condition.
Figure 4G:
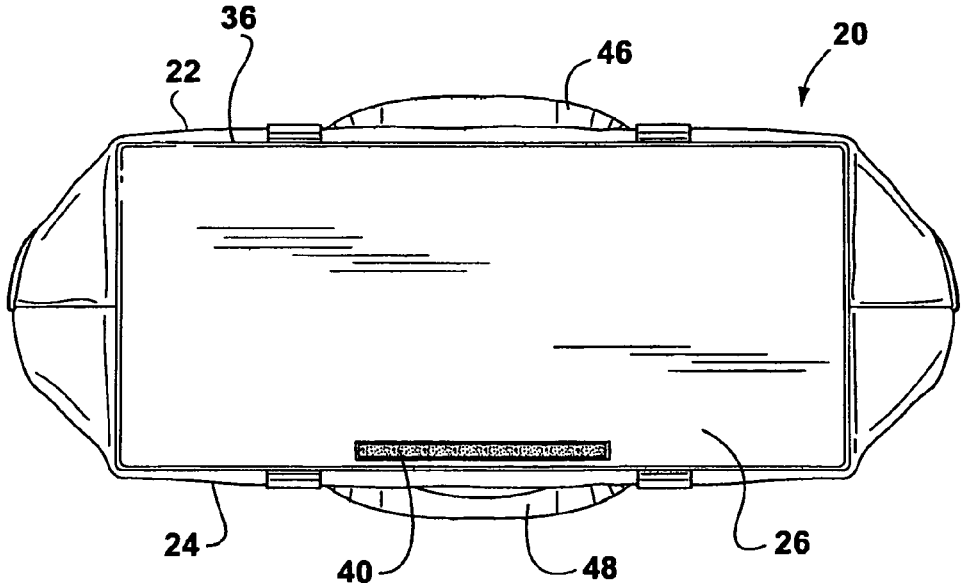
FIG. 4*g* shows a bottom view of the bag of FIG. 4*a* in the fully unfolded condition.

When page-folded in the direction of arrow 'A', bag 20 will arrive at the folded position shown in FIGS. 3*a*-3*g*, in which position it is held by a securement member, or retainer, identified as 34, which may take the form of a pair of mating securement strips such as hook-and-eye Velcro™ strips 38 and 40 mounted, respectively, to the upper body portion of front side panel 22 adjacent the upper margin thereof, and to the distal margin region of base panel 26 that is distant from the forming edge of base panel 26, such that when base panel 26 is overfolded in the direction of arrow 'A' strips 38 and 40 are brought into mating contact in a single relatively uncomplicated, and possibly quite swift motion. The result is a soft sided insulated container that has been collapsed, and then panel-folded over on itself (i.e., not scrunched into a tight roll) to a flat folded position, or flat folded condition, such as may be suitable, for example, for stacking, transport, display or storage. Display and storage is facilitated by a suspension member 42, in the nature of a hang loop 44, mounted generally centrally along the upper margin of front panel 22. To the extent that loop 44 is mounted higher than the center of gravity of bag 20 more generally, bag 20 will tend to hang with the upper margin of front panel 22 in a generally horizontal orientation. An alternate hang loop location is shown in FIG. 3*h*, in which hang loop 44 is located at an end edge such that, when displayed for sale, bag 20 may tend to hang in a vertical, or substantially vertical orientation, namely with the long dimension (as folded) running up and down, i.e., more or less vertically.

Figure 2:
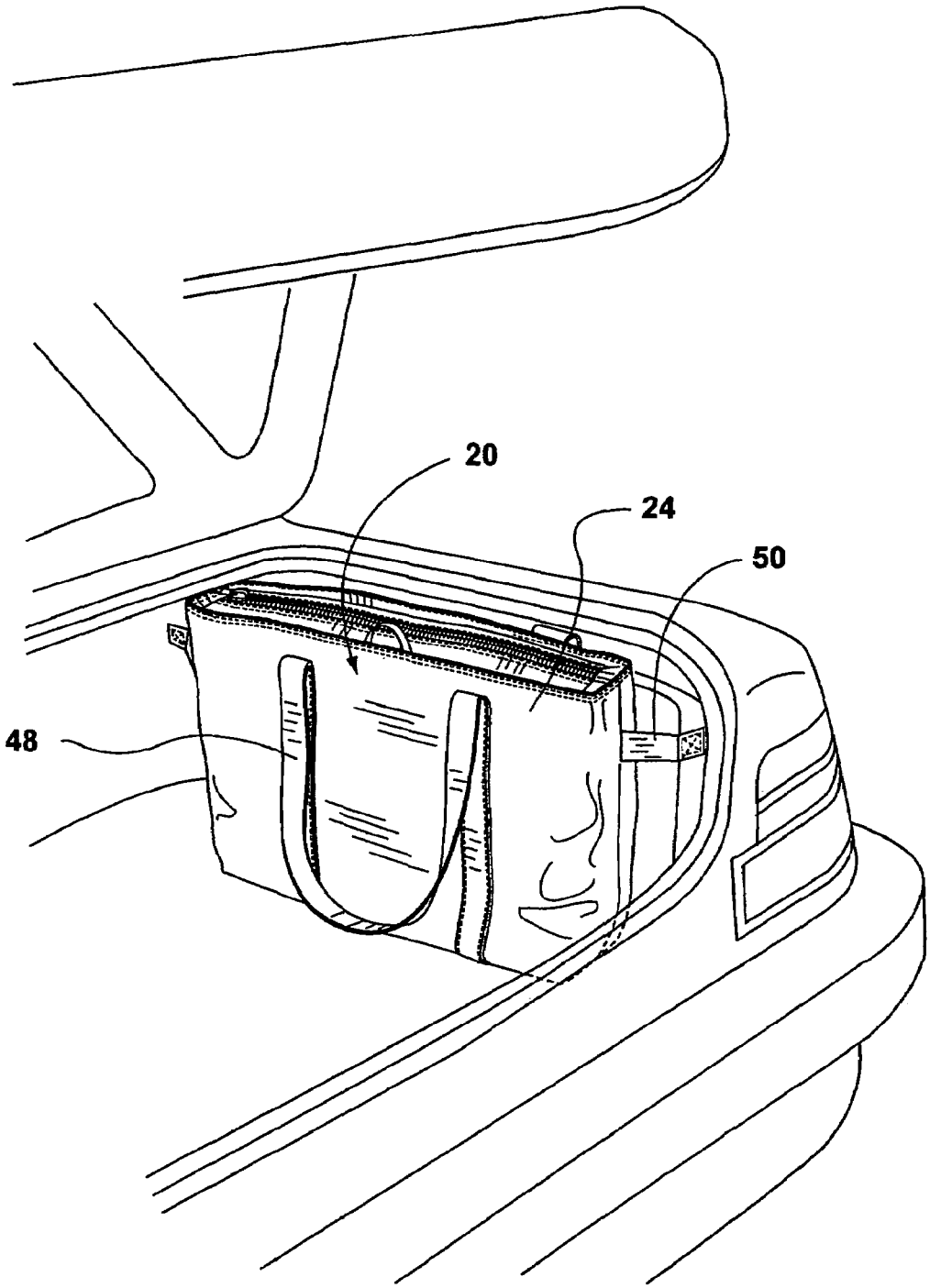
FIG. 2 shows a perspective view of the bag of FIG. 1 as installed in the trunk of an automobile.

Unfolding may tend to be a similarly uncomplicated and convenient procedure: the retainers are released, the bag is unfolded and it is ready to accommodate objects that need to stay cool or warm. When unfolded, lifting members in the nature of handles, or straps 46, 48 that extend from the upper regions of the sidewall panels, namely panels 22 and 24, can be grasped to lift bag 20, and may, as illustrated in FIG. 1, be found suitable for carrying over a person's shoulder. Alternatively, or additionally, as illustrated in FIG. 2, bag 20 is provided with auxiliary securement devices 50, 52, such as may be in the nature of velcro straps, to engage the felt-like or fibrous mat interior of an automobile, especially an automobile trunk, or boot, or cargo carrying area of a station wagon, van, or sports or utility vehicle. Securement devices 50, 52 may tend to be used to discourage a loaded bag 20 from tipping over when travelling, such as when bringing cold items home from the grocery store, or such as when transporting refreshments to a campsite, picnic site, playing field, or arena.

Figure 8:
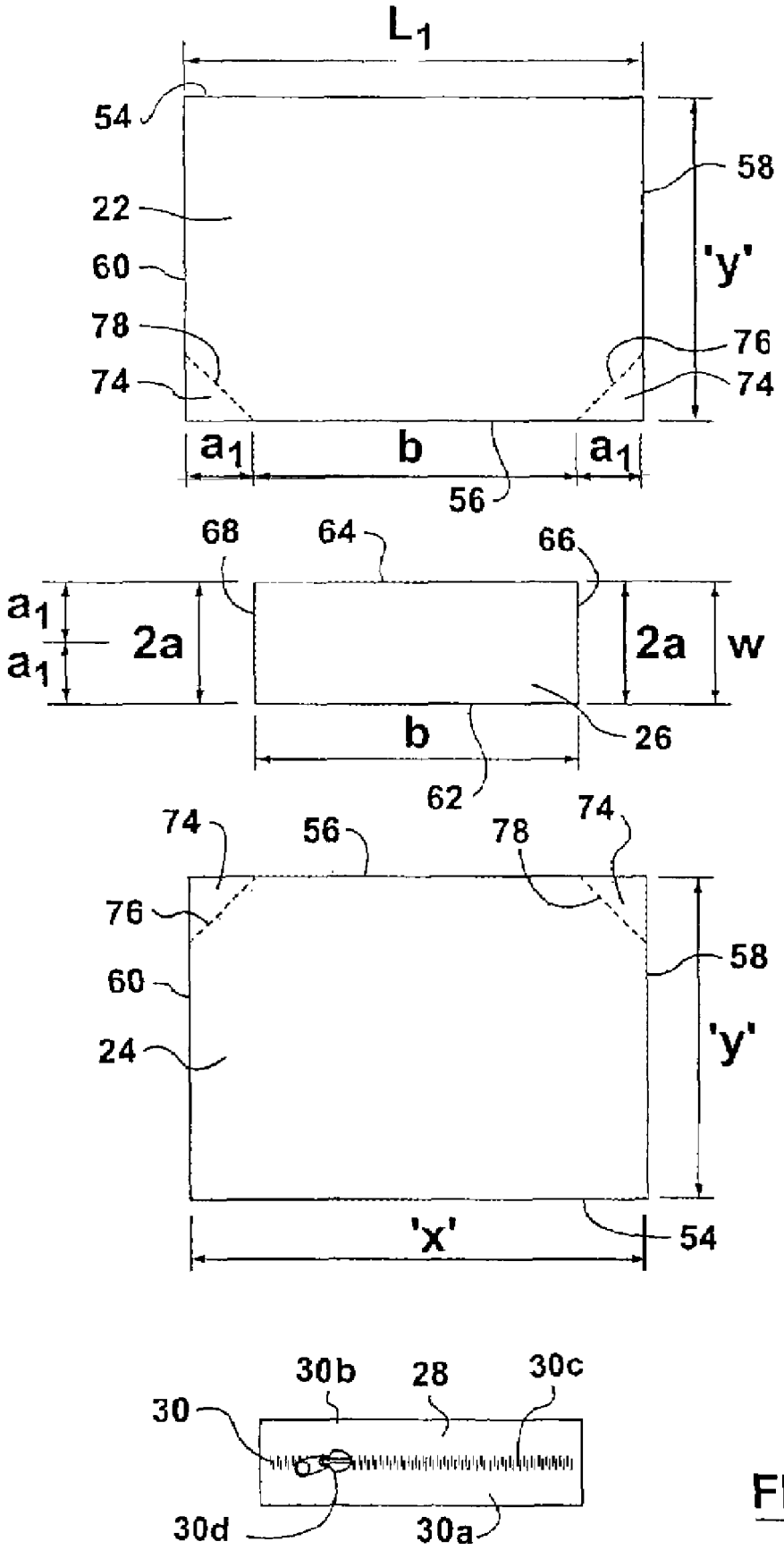
FIG. 8 shows a developed view of panels of the bag of FIG. 1 prior to assembly.

Considering the construction of bag 20 in greater detail, reference is made to the developed views of panels 22, 24 and 26 provided in FIG. 8. In the developed views shown in the example of FIG. 8, the side panels, namely insulated front and rear panels 22 and 24, are of the same size and shape, and are generally rectangular. They have a breadth dimension indicated as 'X' measured along either the upper or lower marginal edges 54, 56, and a height dimension indicated as 'Y', measured perpendicular to dimension 'X', along the upwardly extending side edges 58, 60. By inspection, $L_1$='X'=b+2$a_1$.

Insulated base panel 26 is also generally rectangular, having a long dimension measured along long edges 62, 64, and indicated generally as 'b', and a short dimension measured along the short, end edges 66, 68, indicated generally as 'w'. In this embodiment, the half width of the panel is identified as '$a_1$', and is equal to half of 'w'. The ratio of the half width 'a' to the length 'b' may tend to be in the range of less than about 1:2 and greater than about 1:16, or within the narrower range of less than about 2:5 and greater than about 1:8, or within the preferable range of less than about 1:3 and greater than about 1:6. In one particular example the ratio may be about 3¼:

11½, in another particular example the ratio may be about 3¼:15½, and in a third particular example the ratio may be about 3¾:17½.

The width of base panel 26 may also be related to the overall height of bag 20 when unfolded. That is, it is preferred that retainer strip 40 on the off-side of base panel 26 mate with retainer element 38 on front panel 22 of bag 20 at a region close to the upper edge 70 of bag 20 generally, to yield a neatly folded bag for efficient packing, shipping and display. To that end, with allowance for a bend radius, it is preferred that the height of bag 20 be within +/−20%, and more preferably within +/−10%, of an integer multiple of the width of base panel 26. It is also preferred that bag 20 be a double or triple folded bag. While bags with a greater number of folds are possible, the benefits of ease of manufacture, ease of folding, and ease of use may not necessarily tend to be as marked for a larger number of folds.

The upper edge, i.e., upper marginal edge 54, of each of the side panels 22 and 24 is longer than the long dimension 'b' of the bottom, or base panel 26, such that when the closure member is secured, bag 20 may tend to have an upwardly broadening profile when viewed from the side, and an upwardly narrowing profile when viewed from the end. In the embodiment of FIG. 8, the periphery of base panel 26 is equal to $2(2a_1+b)$. Each of the side wall panels, namely front and rear panels 22 and 24, has a bottom or lower marginal edge, 56 noted above. Each of these lower marginal edges 56 extends about one half of the periphery of base panel 26, having a central portion of length 'b' and two opposite end portions, each of length '$a_1$', or thereabout. In this instance, when bag 20 is collapsed, and bottom panel 26 is laid flat, a triangular end fold will be created, made up of the triangular folds 72 of the bottom corners of the side wall panels, those triangular portions being indicated as triangular regions 74 on FIG. 8, and being bounded by fold lines 76, 78.

When assembled, front and rear panels 22, 24 are sewn together along their upwardly extending side edges 58, 60, the central portions of their bottom edges 56 are sewn to the long sides, or edges 62, 64 of base panel 26, and the end portions are sewn to the half-width portions of end edges 66, 68 of base panel 26. The closure member 28 has the form of zipper assembly 30 as noted above. Zipper assembly 30 has a first side region 30*a*, a second side region 30*b*, and a zipper 30*c*. Side region 30*a* has an outboard, or distal edge seamed into front panel 22, and an inboard edge, or margin, to which one set of teeth of zipper 30*c* is mounted. Side region 30*b* has an outboard, or distal edge that is seamed into rear panel 24, and an inboard edge along which the other set of teeth of zipper 30*c* is mounted. In the usual manner, motion of zipper car 30*d* along the track defined by the zipper teeth controls the opening and closing of the zipper assembly, and hence controls access to the enclosed space 25 of bag 20 more generally, thereby permitting objects to be introduced into, or to be drawn out of, bag 20. Side regions 30*a* and 30*b* each have an upper, load bearing web member 92, 94 and an inner wall member 96, 98. In one embodiment of the invention, inner wall members 96, 98 may be reflective, or have a reflective inwardly facing (i.e., inward relative to the enclosed space 25 of bag 20 so that the reflective surface is oriented toward objects contained in bag 20) surface, and may preferably be made of "Thermoflect"™ material. In another embodiment, inner wall members 96, 98 is a white, water proof nylon sheet. The seaming of the side region of zipper assembly 30 occurs at a height downset from the very edge of the side wall panels by a distance $\delta_1$ roughly equal to the half width $\delta_2$ of zipper assembly 30 such that when bag 20 is folded, side regions 30*a* and 30*b* may tend to fold next to those margins, rather than to protrude excessively.

The overall width of the web-like region, or panel formed by zipper assembly 30 is less than, if not significantly less than, the width of panel 26 such that the through thickness of bag 20 at the elevation of closure member 28 is small, if not very small, relative to the length of closure member 28, and relative to the length of upper marginal edge 54. It is preferred that the overall width of the closure member be less than 60% of the width of the base, and, in a particular example, is about half the width. As such, the ratio of through thickness to bag length may be about $a_2/(2a_2+b)$. This value may typically lie in the range of 1:5 to 1:8 and more narrowly in the range of 1:6 to 1:7½. The closure member is mounted between the upper margins of the side wall panels, namely panels 22 and 24, and, when open, permits at least central portions of those margins to be moved closer together or further apart as may be desired to give access to the enclosed chamber.

Figure 5:
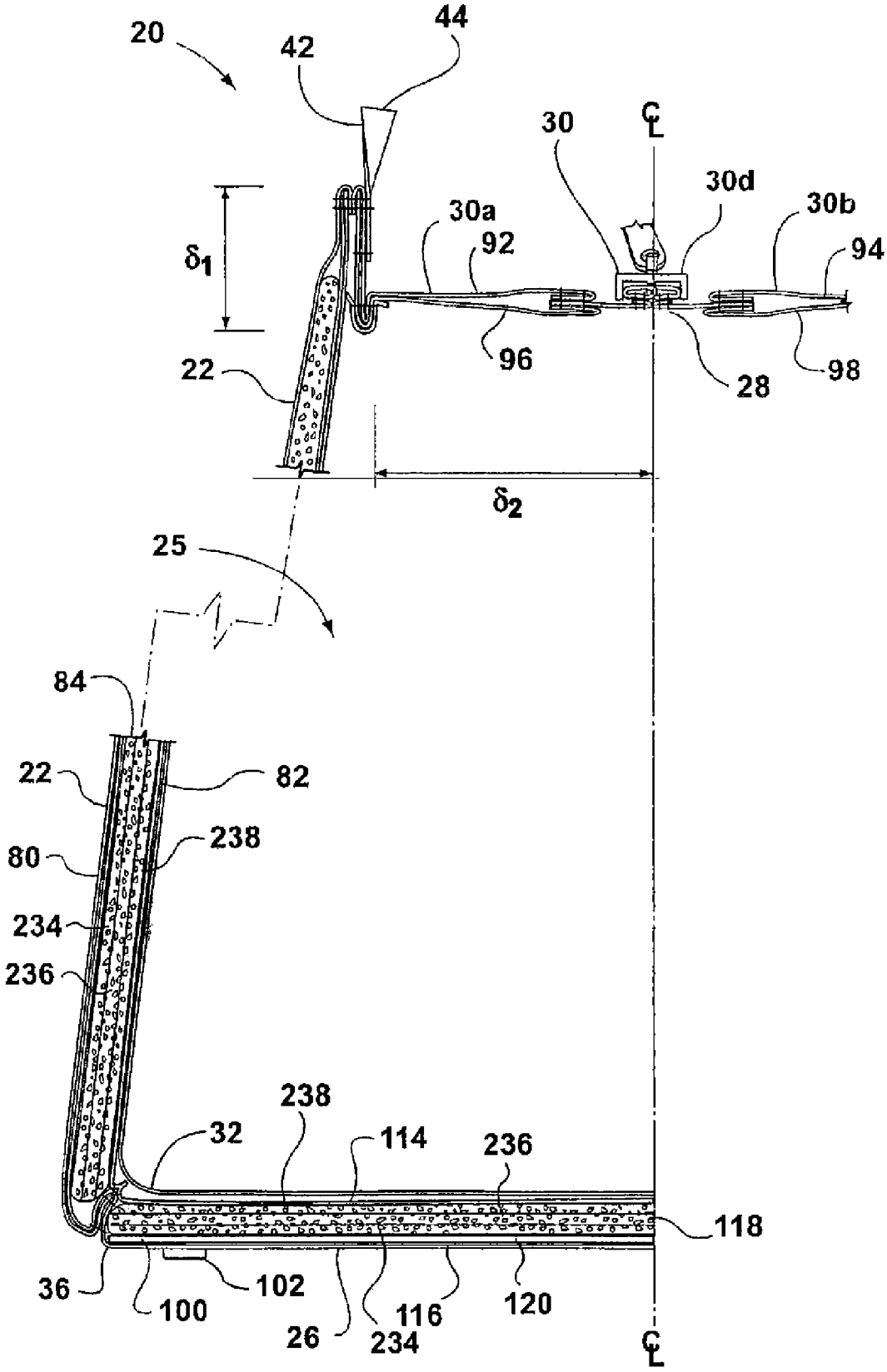
FIG. 5 shows a cross sectional view of the bag of FIG. 1, taken abeam of the handles (with the handles not shown)

The sidewall construction is as shown in FIG. 5. Each of sidewall panels 22, 24 has a relatively wear resistant outer membrane or sheet, or web 80, that may be made of a sheet or woven webbing fabric, such as woven nylon, canvas, or other suitable cloth. Each of sidewall panels 22, 24 also has an inner sidewall membrane, or sheet, or web 82, that may function as a water proof lining, and may be made of a sheet of extruded plastic of the types of polymers that include Vinyl™ or Nylon™, or sheets of monolithic extruded Vinyl™ or Nylon™ sewn together.

An insulating layer 84 is trapped between the inner and outer webs 82 and 80. Insulating layer 84 may preferably be a closed cell polyurethane foam, but could be an open cell insulating foam, or other type of insulating layer, or it may include more than one insulating layer.

As above, in one embodiment the inner sidewall web member may either be made of a reflective material, such as Thermoflect™ sheeting, or may have a reflective surface oriented to face toward objects contained within bag 20. Alternatively, inner web 82 member may be made of a water proof extruded nylon or vinyl sheet, or seamed sheets, to discourage leakage of liquids from bag 20.

Figure 7A:
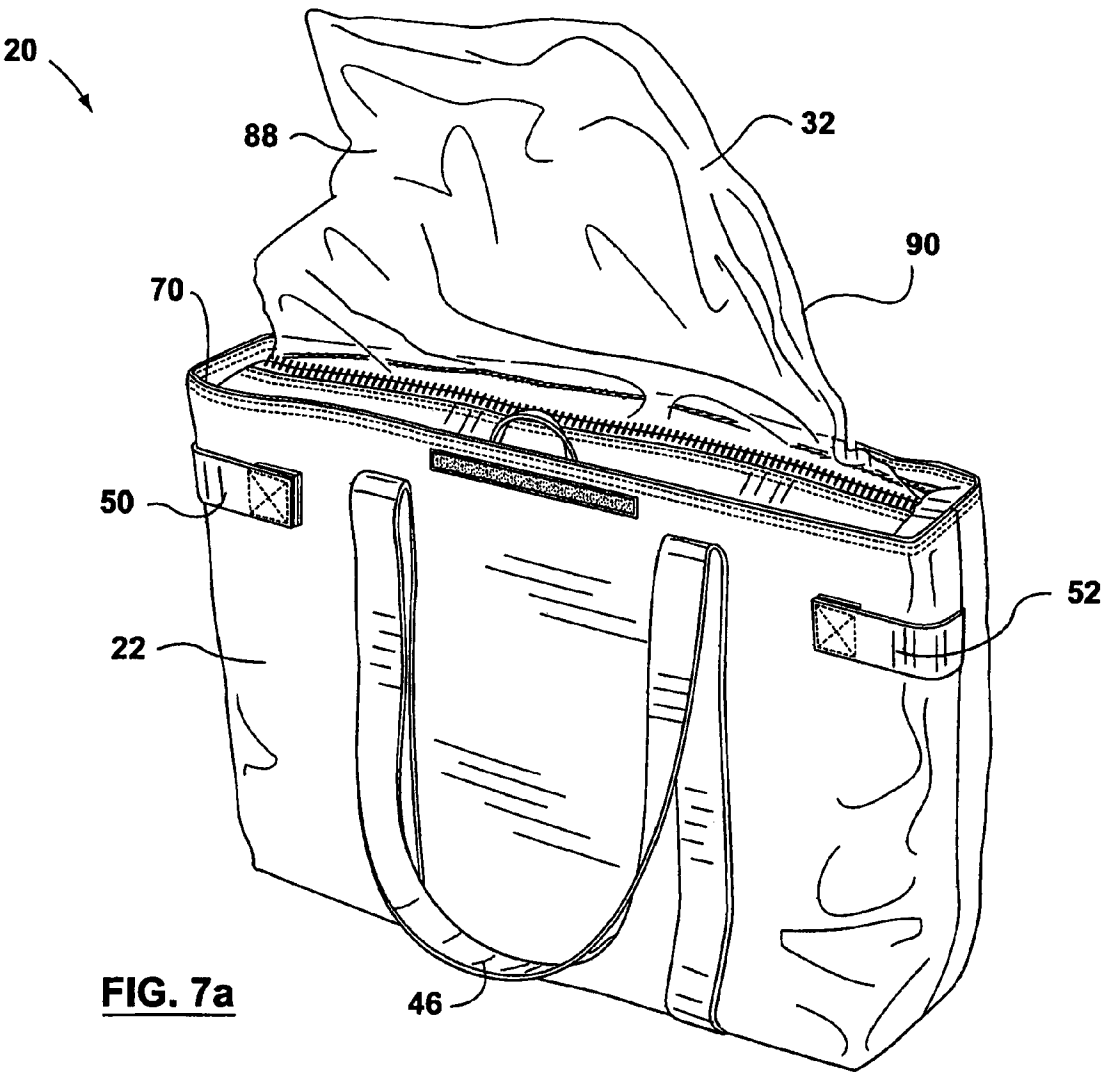
FIG. 7*a* shows a perspective view of the bag of FIG. 1 in an open condition with a liner thereof in an inverted position to facilitate washing thereof.
Figure 7B:
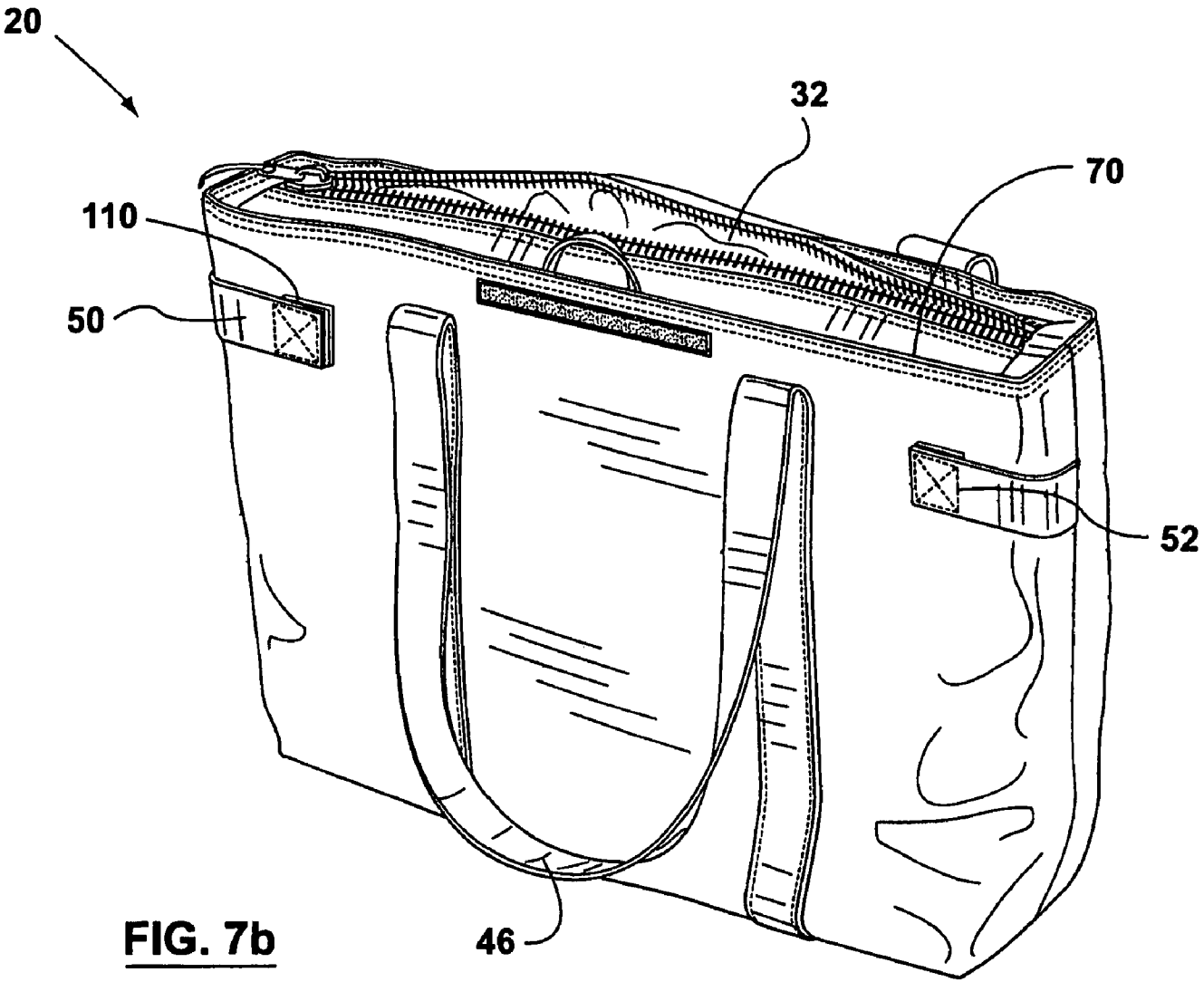
FIG. 7*b* shows a perspective view of the bag of FIG. 1 in an open condition.

Optionally, water-proof liner 32 may be included, in addition to the internal sidewall web sheet, namely, web 82. Where the inner sidewall surface is reflective, the liner may preferably be translucent, or clear, to permit the reflective surface of the inner wall to be seen. Although the liner can be rigidly sewn in place to prevent the liner from being inverted, it is preferable for the liner to be either removable, or to be sewn in at its upper peripheral edges, thus permitting at least partial inversion of the liner as shown in FIG. 7*a*, and hence to facilitate washing. The optional liner 32 may be made from a single polymer sheet, having a first side region and a second side region. The side regions are heat welded along their side margins to form a pouch, or pocket, commensurate with the general size and shape of the inside of bag 20, and have their upper margins seamed into the side-walls of bag 20 at the juncture with the side regions of zipper assembly 30. Bag 20 will then tend to be water-proof to a height corresponding to the height of closure member 28. It is advantageous, and desirable, for a soft sided insulated wall assembly for use as a cooler, such as bag 20, to be generally leak resistant, if not even more preferably, water-proof.

The cross-sectional structure of base panel 26 is generally similar to the cross-sectional structure of the sidewall panels, having an inner wall skin, or panel or web 114 that is of consistent construction to the inner wall sheet or web 82, and an outer wall skin, or web 116 that is of consistent construction to outer web 80. It may be noted that the outer web 80 may not be the same colour as outer web 116, and may not be of the same weave or fabric. It may have a heavier, more wear resistant fabric, or coarser, more wear resistant weave, since base panel 26 may tend to be placed in contact with the ground, or other underlying surface whether a paved roadway, concrete, rocks, earth, flooring, or some other support surface against which it may be expected to be slid, or to rub, in the course of use.

Base panel 26 may also have an insulated layer, 118, captured between webs 114 and 116, the insulated layer being made of an insulated foam, or other suitable heat transfer resistive medium as described above. In addition, base panel 26 has a stiffened form member 120, that may be in the nature of a rectangular, hard plastic sheet 100 of modest thickness located between insulating layer 118 and outer web 116. Sheet 100, in plan view, has dimensions that are the same as, or roughly the same as, dimensions 'b' and 'w'. Form member 120 serves two functions, the first being to provide a stiffened base upon which bag 20 can tend preferentially to stand, and which may tend to aid in discouraging bag 20 from tipping over as easily as it might otherwise do. The second is to provide a forming edge to base 26 by which to pre-determine the fold line, or lines, at which bag 20 will tend to want to bend when being folded up. This may tend to discourage the tight-rolling of bag 20, and to encourage repeatable panel folding to and from the convenient folded form shown in FIGS. 3*a*-3*g*.

Form member 120 need not be a continuous monolithic panel. It could be an open frame, or a peripheral member sewn in place to provide a reinforced edge. In one embodiment, even without form member 120, the seaming at the edge of insulated base panel 26 may tend to yield a natural fold location at which bag 20 may tend to prefer to bend or fold. The inclusion of member 120 may tend to strengthen or to enhance this tendency. Modestly sized feet, stand offs, or pads, 102, may optionally be provided to the underside of panel 26. Further, form member 120 may, by itself, tend to have a greater flexural stiffness that the adjacent layer of insulated material, and when taken together the resultant bi-laminar, or possibly multi-layered assembly, has a combined flexural stiffness that may tend to be significantly stiffer than any other portion of bag 20.

Lifting members, or carrying members, in the nature of straps, or web bands 46, 48, are sewn up the outside faces of side wall panels 22 and 24, having their roots at the seamed junction between bottom panel 26 and the side wall panels 22, 24. Each of bands 46, 48 has a central portion 104, 106 that extends upwardly beyond the upper margins of the sidewall panels to provide a grasping, or carrying portion that can be held or place over a user's shoulder, as in FIG. 1.

Auxiliary securement straps 50, 52 have a root end sewn into the upper region of the seam between panels 22 and 24, at a height near the height of closure member 28. The distal ends of straps 50, 52 bear velcro patches 110, suitable for securing in to the trunk fabric of an automobile (or, alternatively, mating velcro patches can be mounted inside the automobile for this purpose). When not in use, the ends of straps 50, 52 mount to mating velcro patches located on the outward face of front side panel 22. Straps 110 could as easily be oriented to face in the other direction, and to mate with patches sewn on rear panel 24.

Figure 9A:
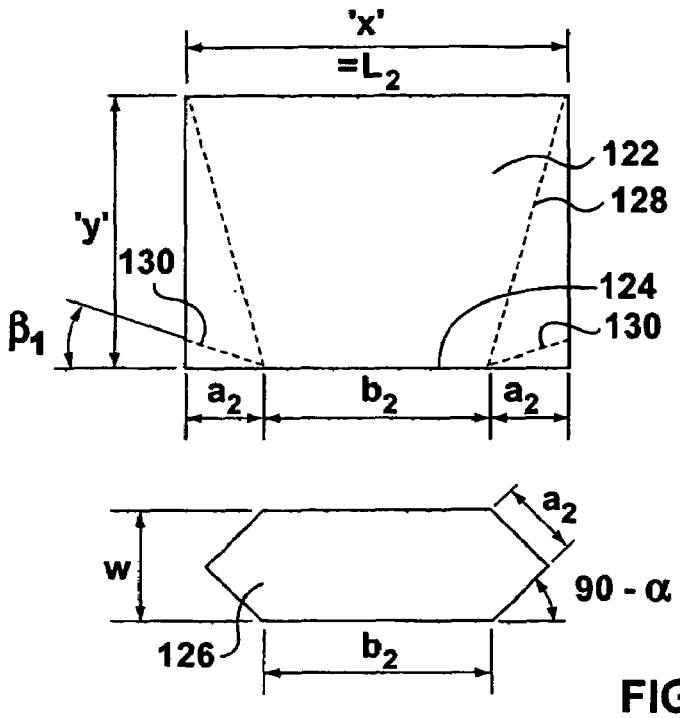
FIG. 9*a* shows a developed view of a bottom panel for an alternate embodiment of the foldable insulated bag of FIG. 1.

In the embodiment of FIG. 9*a*, an alternate insulated base panel 126 has the same structural and thermal properties as base panel 26 in general, but differs in that rather than being rectangular in plan view, base panel 126 has a length, or long dimension, indicated as '$b_2$' and a width indicated as 'w'. These dimensions need not be the same as 'b' and 'w' indicated above, but may be. In this case the ends of panel 126 are not squared, but rather are mitred at an angle $\alpha$ relative to the perpendicular to the long edges. The length along each of the mitred edges is then given as '$a_2$'. In this case the half width of base panel 126 is not $a_2$, but rather $a_2 \cos \alpha$. The periphery of base 126 is $2(b_2+2a_2)$.

The adjoining side panels are again taken to be 'X' wide, and 'Y' high, and to be of the same general insulated construction as side wall panels 22 and 24, as shown, for example, in FIG. 5. The length of the lower margin 124 of each of the adjoining side panels 126 is then $(b_2+2a_2)$. Each panel will then have a "large fold" 128 and a "small fold" 130. Large fold 128 is a nominal indication of where there would be a fold in the side wall of the bag in the fully unfolded condition ready for filling with diverse objects, if a sharp crease were made. In actual use, the corner will not be creased, but rather will tend to take on a more rounded, or radiused form, and the bag will tend to conform to the shape and bulkiness of objects placed in it, so the actual corner of the bag may have a bulging appearance rather than a sharp corer. Small fold 130 indicates the actual location of a fold that is made when the bag is in a collapsed state and folded for storage.

The angle $\beta_1$ of small fold 130, when the bag is folded for storage, will then tend be roughly equal to the bisector of the angle between the extension of the horizontal fold line defined by the edge of base 126 and the mitred edge, namely $\frac{1}{2}(90-\alpha)$.

Base panel 126 need not necessarily be a straight sided polygon, as are base panel 26, but could have somewhat rounded, oval or irregular ends. However, in such a case the end fold may tend to be puckered, and may tend not to lie as flat as might otherwise be considered desirable or preferable. However, a straight sided polygon is advantageous, and a square-cornered (i.e., rectangular) end is preferred since it may tend to facilitate manufacture and efficient use of materials and reduced waste cuts.

Bag 20 is a "double fold" bag. That is, base panel 26 is folded flat at a first fold (the offside edge of base panel 26), and then side panels 22 and 24 are bent about the second fold (the nearside edge of base 26). In alternate embodiments, a soft sided, collapsible and foldable insulate single-fold bag could be produced, or a triple-fold, or more, bag could be produced.

An example of a single fold bag 140 is shown in FIGS. 10*a*-10*g*, the views corresponding generally to the views of double fold bag 20 shown in FIGS. 3*a*-3*g* respectively. Except as otherwise indicated, bag 140 has the same general construction as bag 20, having insulated side wall panels 142, 144, and an insulated base panel 146, with a similar closure member 148 and optional liner similar to liner 32. Bag 140 differs from bag 20 in being a single fold bag, rather than a double fold bag, and has changes in dimension and aspect ratios accordingly. In place of the arrangement of retention member 40, a retention member 150 may be mounted near the lower margin of the front panel 142, and another, mating, retention member 152 would be mounted near the upper edge of the front panel, the two mating when the base panel is moved to a collapsed position in which it is laid over against side panel 142.

Figure 10A:
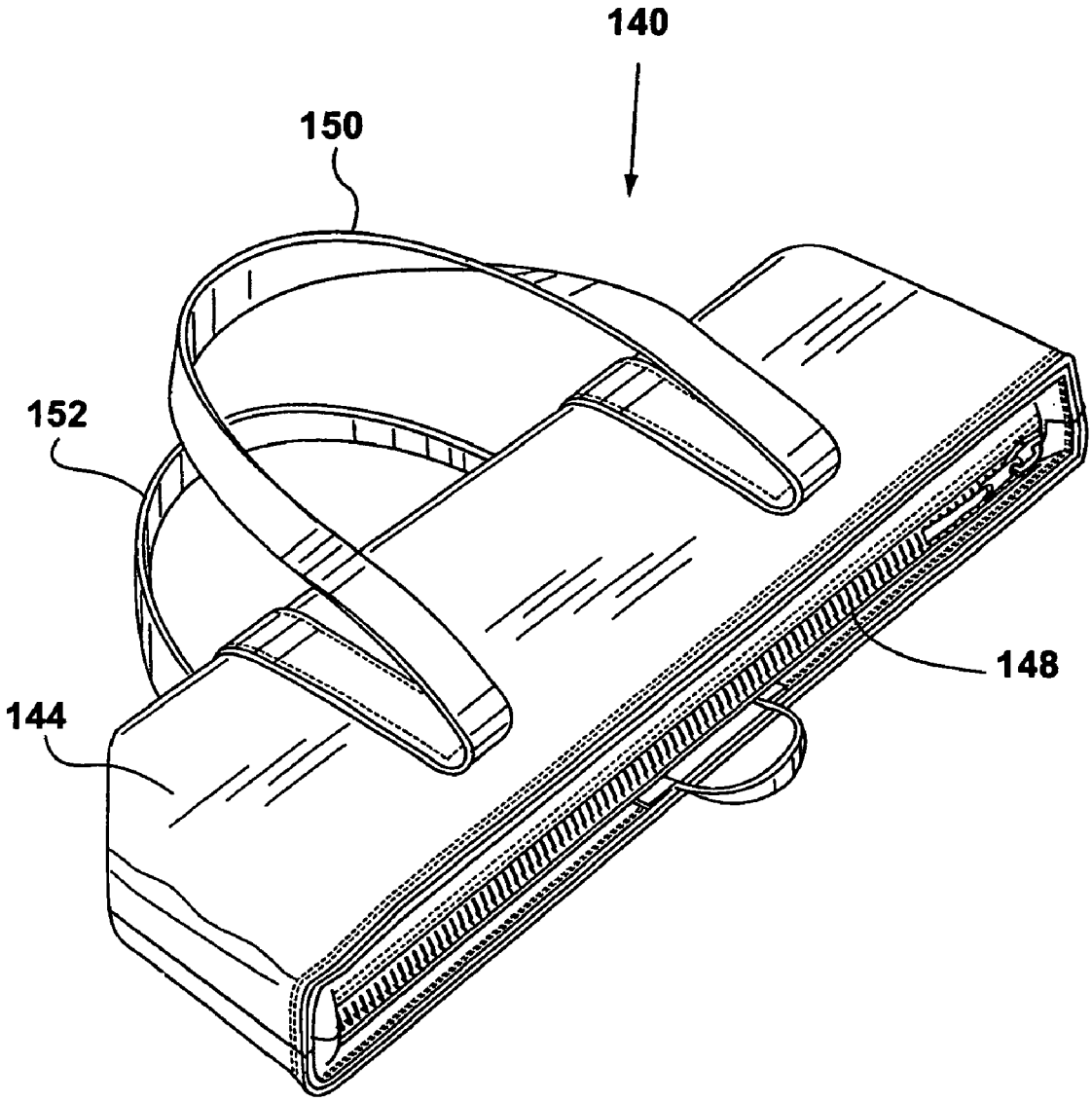
FIG. 10*a* shows an isometric view of a single fold, alternate insulated bag to that of FIG. 1.
Figure 10C:
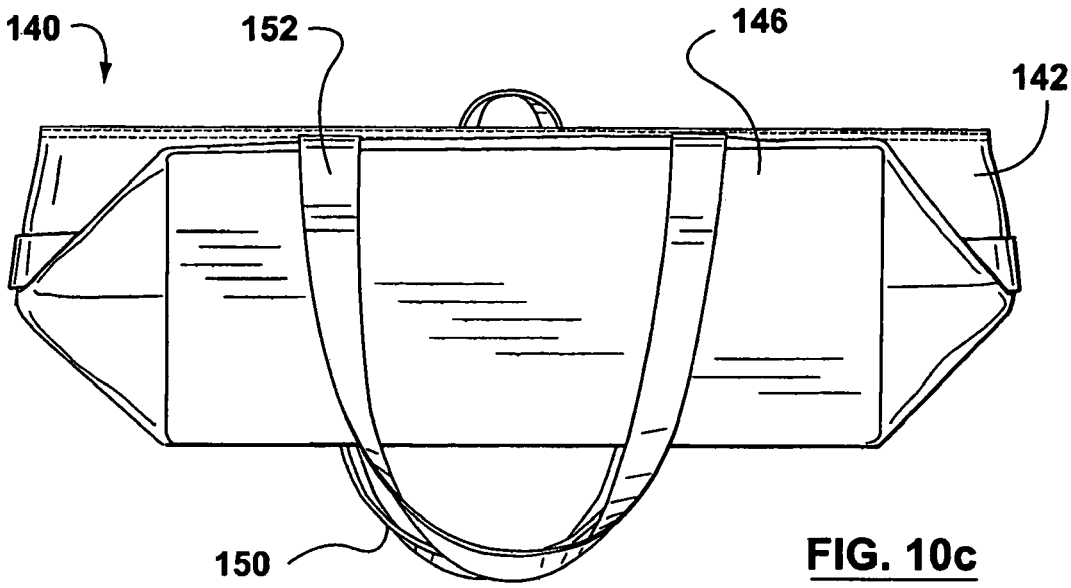
FIG. 10*c* shows a rear view of the insulated bag of FIG. 1*a* in a folded condition.
Figure 10B:
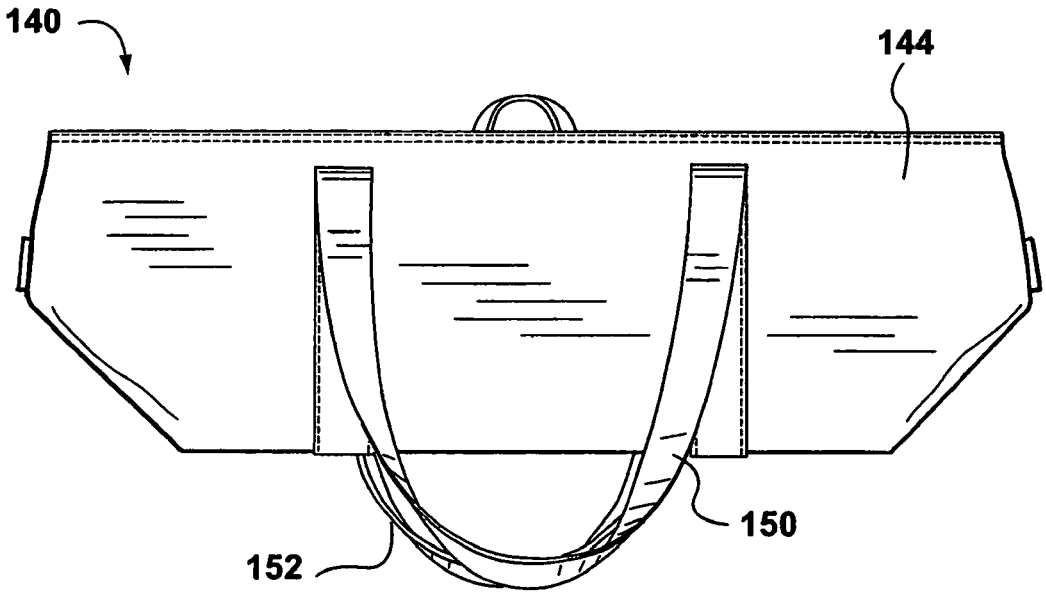
FIG. 10*b* shows a front view of the insulated bag of FIG. 1*a* in a folded condition.
Figure 11A:
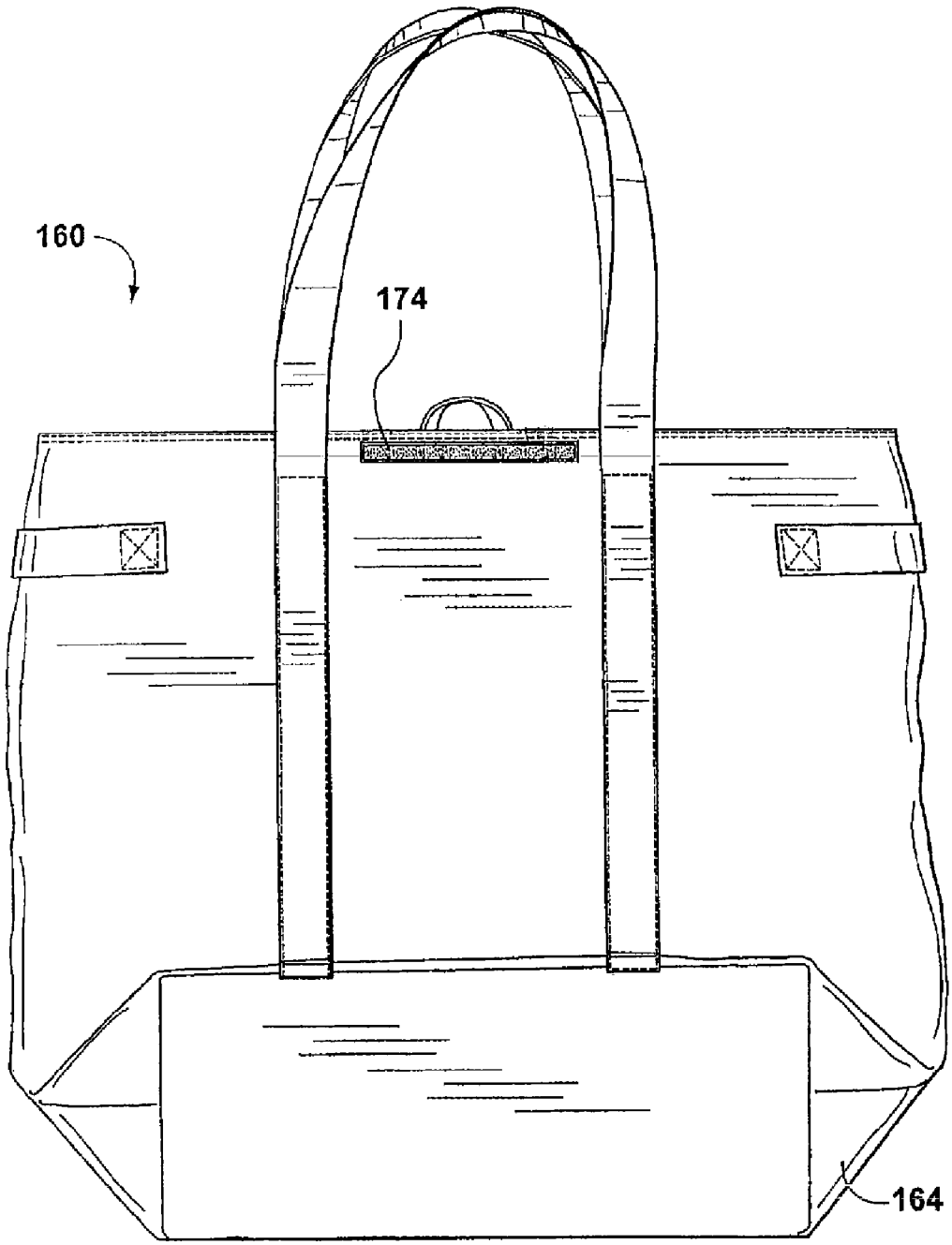
FIG. 11*a* shows a partially unfolded front view of a triple fold, alternate insulated bag to that of FIG. 1.
Figure 11C:
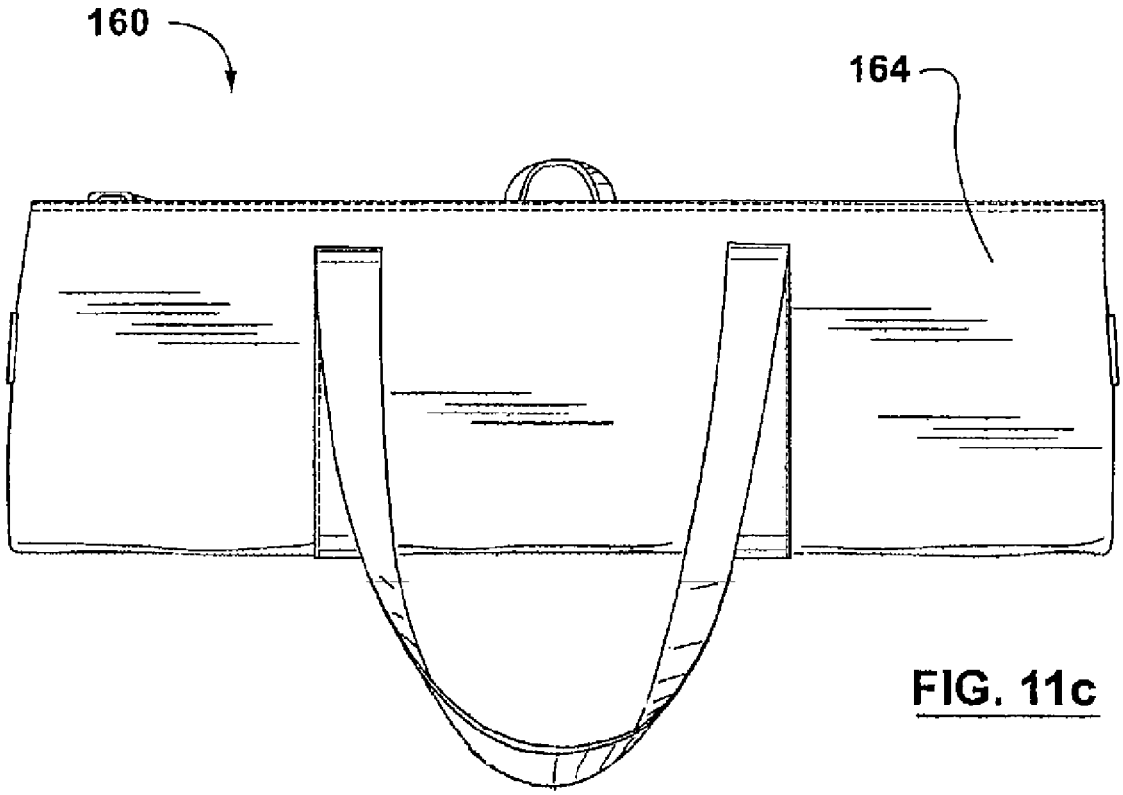
FIG. 11*c* shows a rear view of the insulated bag of FIG. 11*a* in a folded condition.
Figure 11B:
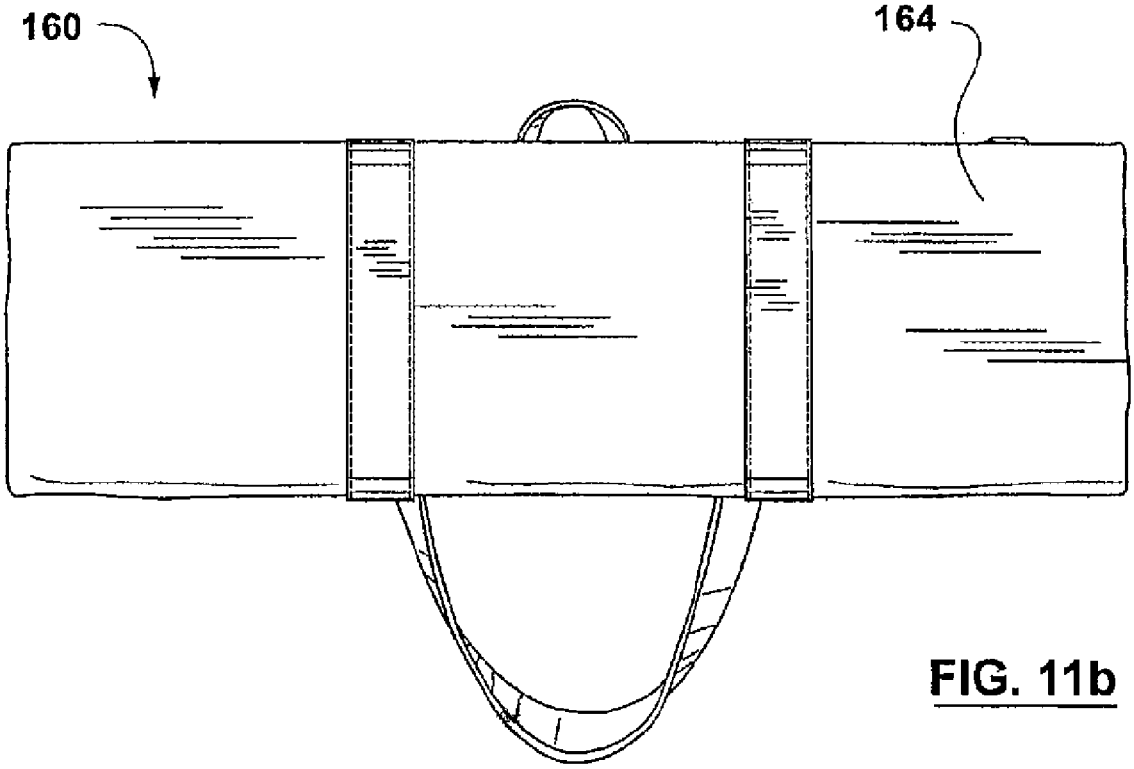
FIG. 11*b* shows a front view of the insulated bag of FIG. 11*a* in a folded condition.
Figure 11G:
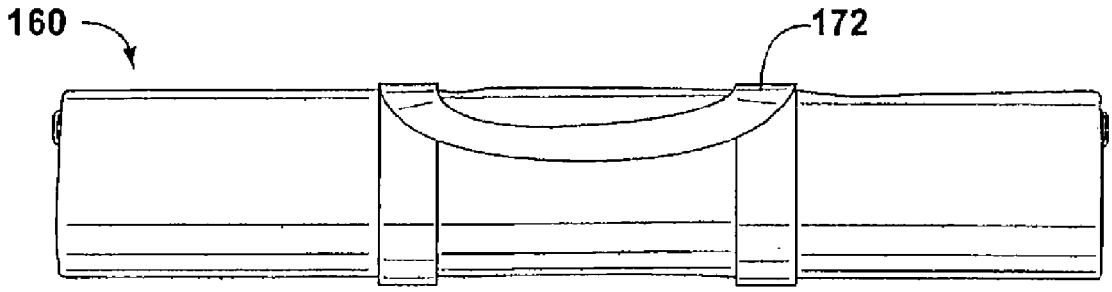
FIG. 11*g* shows a bottom view of the insulated bag of FIG. 11*a.*
Figure 11F:
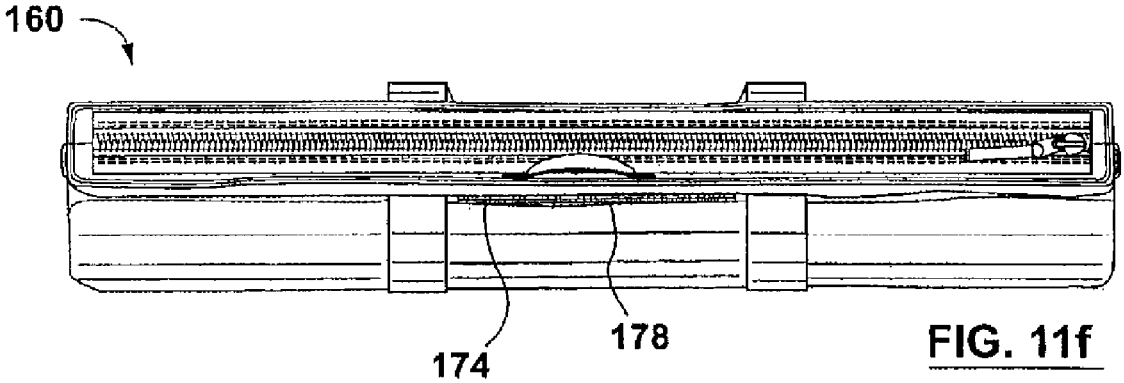
FIG. 11*f* shows a top view of the insulated bag of FIG. 11*a;*
Figure 11E:
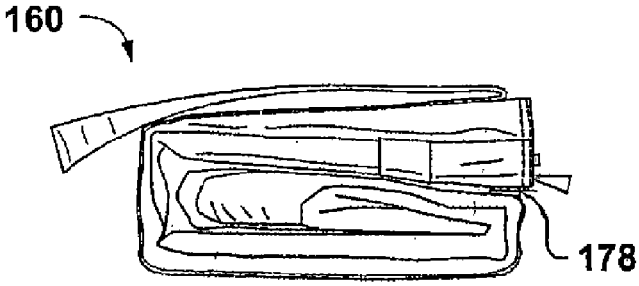
FIG. 11*e* shows a right hand end view of the insulated bag of FIG. 11*a;*
Figure 11D:
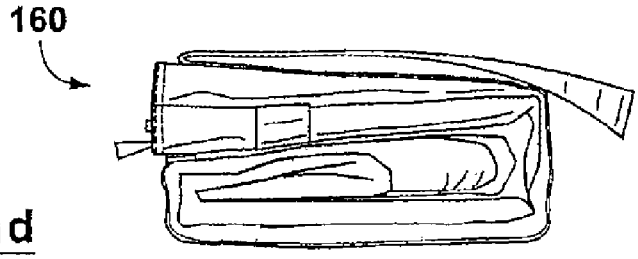
FIG. 11*d* shows a left hand end view of the insulated bag of FIG. 11*a;*

An example of a triple fold bag 160 is shown in FIGS. 11*a*-11*g*. FIG. 11*a* shows triple fold bag 160 in a collapsed, or flattened condition immediately prior to folding into the storage position (or, alternatively and equivalently, immediately after being unfolded, and before filling). Bag 160 is presented as being symbolic of not only a bag having three folds. In general, for a bag, such as bag 160, having three or more folds, the retention member 178 would be located on the front face 164 roughly the width of two folded panel regions below the upper edge of the front face with the second retention member being mounted near or at the upper edge, such that, when folded the two parts, namely retention member 178 and a mating retention member 174 would tend to mate. An example of a single fold bag is illustrated in FIG. 10*a*. An example of a triple fold bag is shown in FIG. 11*a*.

Figure 9B:
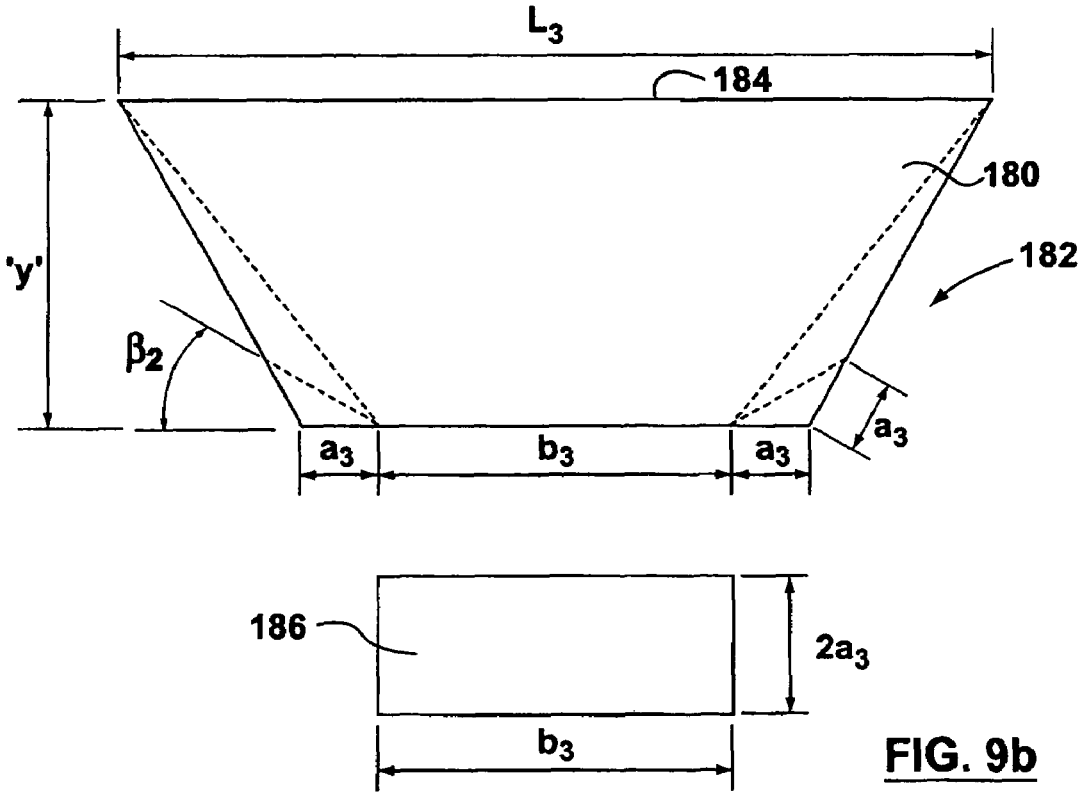
FIG. 9*b* shows a developed view of a side panel for an alternate embodiment of the foldable insulated bag of FIG. 1.

In the examples discussed so far, the upper edge of a bag having rectangular sidewall panels is $L_i=2(a_i+b_i)$, whether i is 1 or 2. As shown in FIG. 9*b*, in which the subscript i is 3, such that $L_i=L_3$, $a_i=a_3$ and $b_i=b_3$, the side panels of bag 20 need not be made from rectangular sheets, but could be made from sheets that are of a different shape, such as the trapezoidal side panel sheets 180. In this case, the resultant bag 182 would tend to have an upper edge 184 for which the length $L_2$ would tend to be greater than the sum of the $b+2a_i$, or, put generically, where $L_i$ is greater than half the total periphery of the base panel 186. This may tend to yield a more flared appearance when the bag is seen in an unfolded side view, and may tend to yield a larger access opening, such as may permit objects of greater relative size to be introduced into the insulated spaced.

Referring to the embodiment of FIGS. 12*a* to 12*f*, a bag 220 has an insulated wall structure 222 such as may include a first side panel 224, a second side panel 226, and a base or bottom panel 228. These may be of the same, or generally the same, construction and assembly as any of the embodiments of FIG. 1, 9*a*, 10*a*, or 11*a*, described hereinabove, as may be, and may have the folding, closure, and securement features as described above in the context of those other embodiments. Bag 220 is illustrated as having a width or breadth, L, a height or depth D, and a through thickness T, which, in a tapering bag, may vary according to the taper. That is, in the example T may be greater at the bottom than at the top, (or, in other embodiments, the other way around, or equal). In any event, T as indicated may be taken as the mean value over the depth of bag 220. Typically, L and D may be of generally similar magnitude (within a ratio in the range of 2:3 to 3:2 of each other. Each of L and D may be more than double the magnitude of T, and one or another, or both, may more typically be in the range of 2 to 8 times T, or, more narrowly, in the range of 2.5 to 6 times T.

Figure 12A:
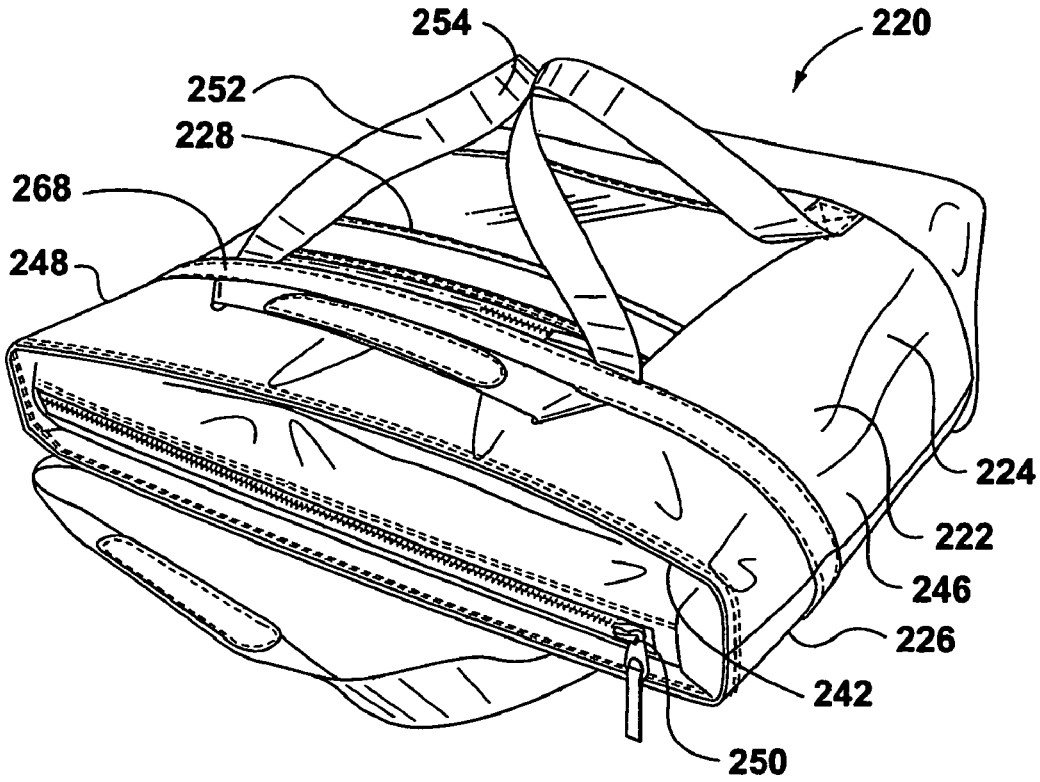
FIG. 12*a* shows an isometric view of an alternate embodiment of insulated bag to that of FIG. 1, showing handles thereof loosely in a first position.
Figure 12B:
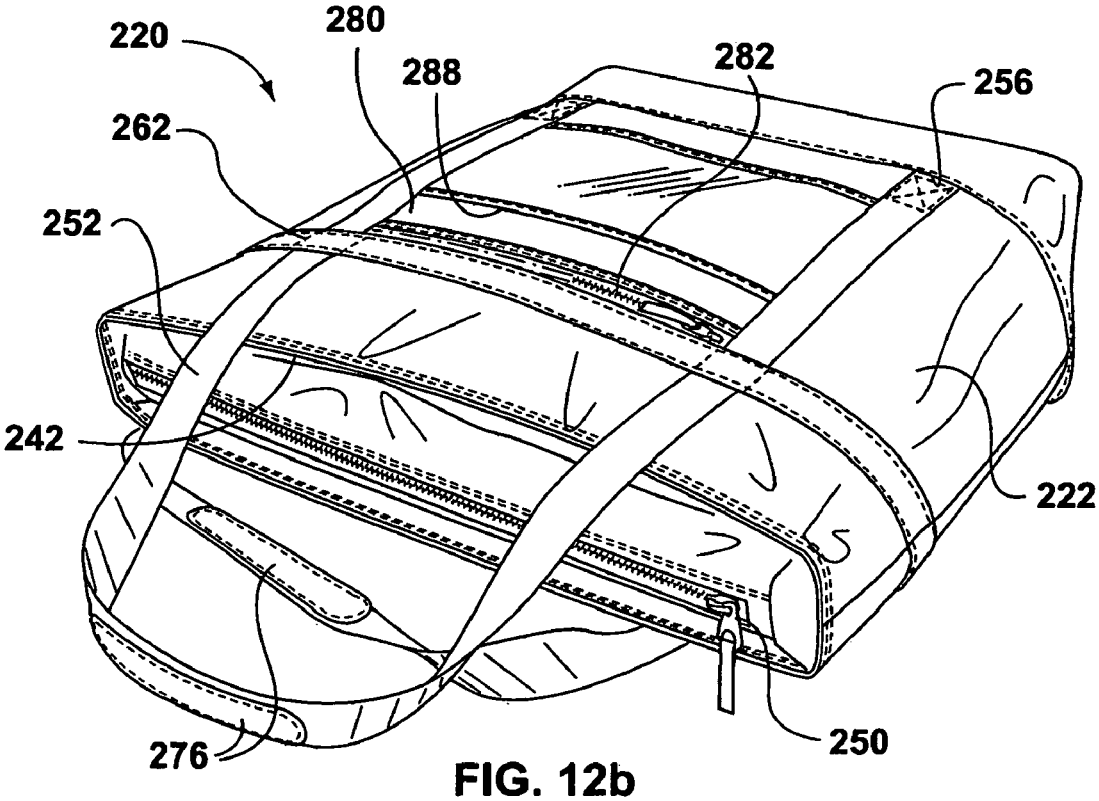
FIG. 12*b* shows another view of the insulated bag of FIG. 12*a* in a standing condition, with a handle thereof in a second position.
Figure 12C:
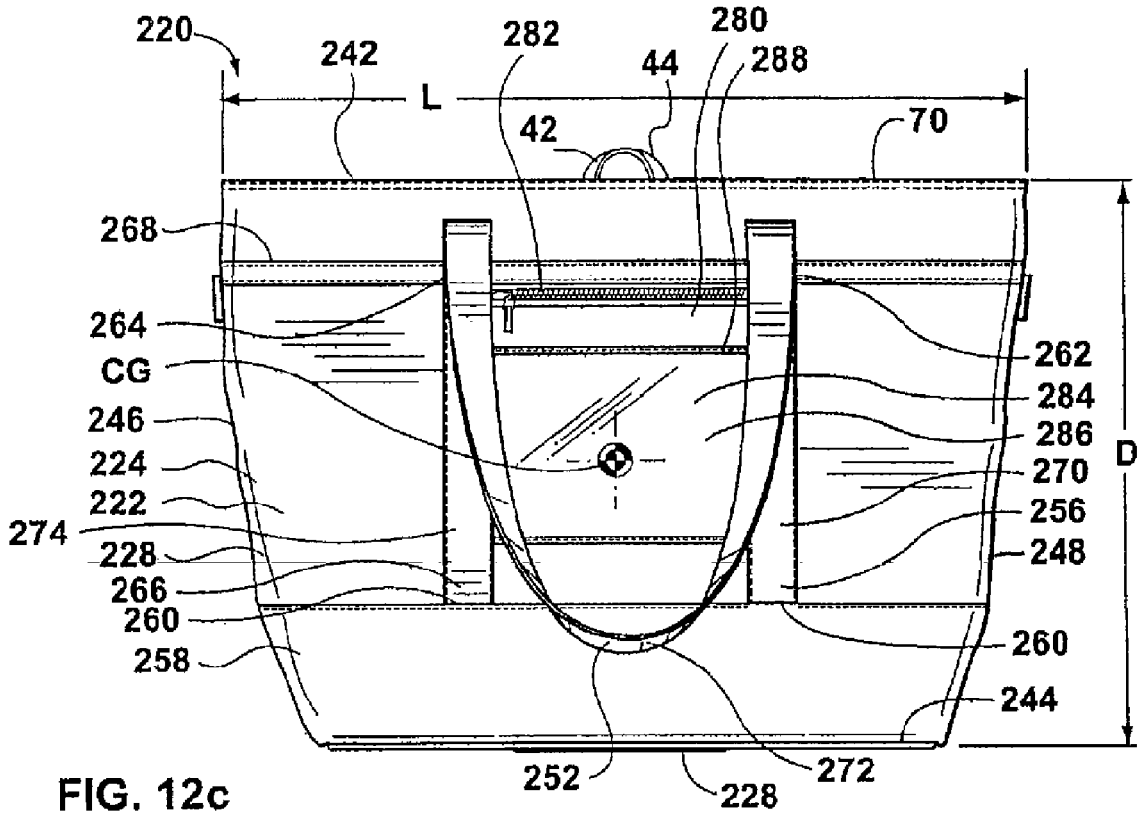
FIG. 12*c* shows a first side view of the insulated bag of FIG. 12*a;*
Figure 12D:
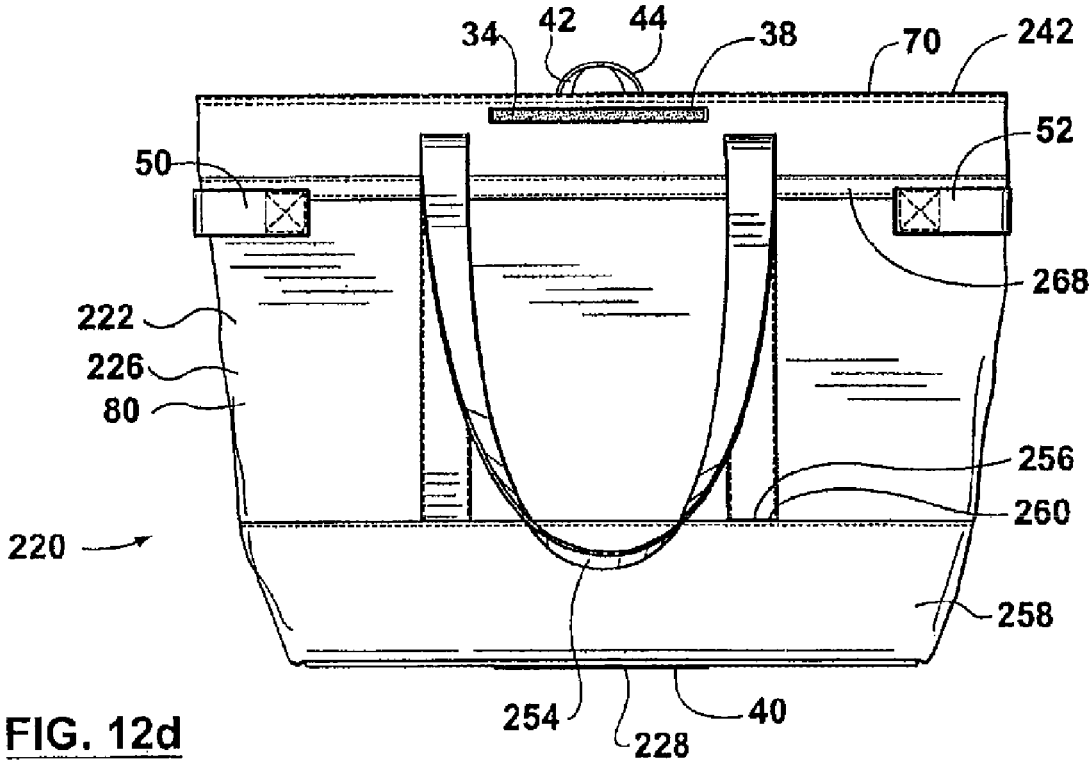
FIG. 12*d* shows an opposite side view to that of FIG. 12*c;*
Figure 12E:
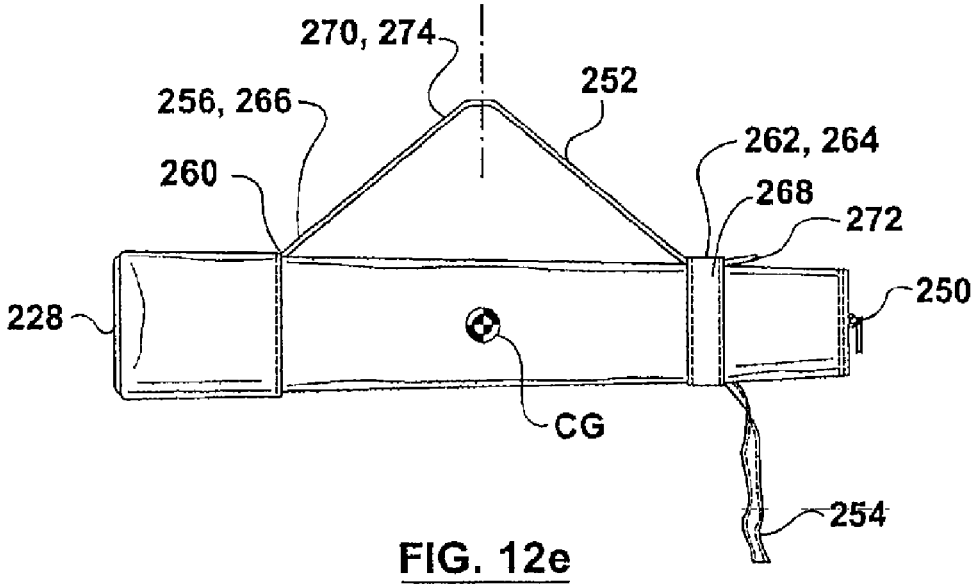
FIG. 12*e* shows a predominantly horizontal lifting position of the insulated bag of FIG. 12*a*.

Bag 220 may also be thought of as having a center of gravity, CG, which is generally centrally located, being generally at or near the geometric centroid (as it may be taken to be illustrated) of panel 224 or 226 as viewed from the side as laid flat (FIGS. 12*c* and 12*d*), and in the central, or middle, plane of the bag as viewed from the end (FIG. 12*e*). The center of gravity is intended to be notionally representative of the bag when it is filled with lading. Given that bag 220 may be employed for a wide number of purposes, the actual laden C of G may not be precisely in the notional location shown. In the predominantly upright condition, the C of G may quite probably be located somewhat lower down. However, when in the mode of carrying hot food, such as a pizza, in a generally horizontal or level configuration, the actual C of G may be quite close to the notional C of G illustrated.

The insulated wall structure may include a relatively robust outer layer or covering namely web 80, such as may tend to be wear resistant or tolerant of the abuse and roughness of everyday service. There may be an inner layer or covering, 82, which may be a reflective sheet. There may also be a layer of open or closed cell foam, namely insulating layer 84 sandwiched between the inner and outer layers, such as to form a thermally insulative assembly. It may be that the thermal insulation is itself made of strata, those being an outside layer of closed cell foam 234, a middle layer of open cell foam, 236, and an inside layer of closed cell foam 238 (that is, the open cell foam is bounded on both faces by closed cell foam). The layers may have relative thicknesses in which the closed cell layers are thinner than the open cell layer. In one embodiment, the ratio of thicknesses of the layers may be in the order of about 3:4:3. A substantially water proof or water resistant liner 88, which may be in the form of a clear plastic vinyl material, may be contained within the inner layer of the wall structure.

Each of panels 224 and 226 may have first and second generally opposed top and bottom margins 242, 244, and generally opposed first and second side margins 246, 248. Bottom margin 244 may adjoin base member 228, and top margin 242 may be located adjacent to a closure member 250. The term top and bottom are arbitrary, and correspond to the orientation shown in FIG. 12*f*, in which the top is located generally higher than, and generally above, the bottom. The corresponding side margins of panels 224 are mutually connected to form the continuous insulated peripheral of the sidewall structure more generally. Closure member 250 may be substantially as previously described in the context of other embodiments.

Bag 220 may also have first and second lifting members, 252, 254. Lifting member 252 will arbitrarily be termed an upper or top or front, or primary lifting member, and lifting member 254 will arbitrarily be termed a lower or bottom, or back, or secondary lifting member. Each of lifting members 252, 254 may be termed a handle, and may be in the nature of a flexible filament or substantially linearly extending flexible member, or cable, or rope, or web, or band. As a convenience, the term strap may be used for either of items 252, 254 as a generic proxy for these other alternatives.

Lifting member 254 may be of substantially the same configuration as any of the strap handles described hereinabove, such as items 46 and 48, or may be of the same, or similar, configuration to that of lifting member 252. Lifting member 252 may be somewhat different. Lifting member 252 may have a first end 256 anchored in a first location relatively close to second margin 244, or relatively closer thereto than to first margin 242. That anchor point may be referred to as a point of retention, or a retainer, or a securement fitting 260. In this instance, it may be a fixed retainer. For example, the base region of bag 220 may include an outer doubler covering, or a single heavier grade, more abuse tolerant skin or surface, or webbing 258. First end 256 may be anchored at the join of webbing 258 to the main portion of the outer skin, namely outer covering 80 more generally. Lifting member 252 may then be threaded or fed through a first guiding or retaining member, identified as first retainer 262, have a portion extending beyond retainer 262, then be fed back through a second retaining member or retainer 264, and have a second end 266 anchored once again relatively closer to second margin 244 than to first margin 242. Retainers 262 and 264 may be mounted in a region of panel 222 that is relatively near to first margin 242, or rather closer to margin 242 than to margin 244.

Retainers 262 and 264 may tend to stand to one side of the center of gravity, while first and second ends 256 and 266 may tend to stand on the other side, such that the centroid or center of gravity, as may be, is in a sense between the retainer and the anchor point, or retainers and anchor points in the depth direction. In the breadth direction, retainer 262 and one anchor point 260 may stand to one side of the centroid and center of gravity, and the other anchor point 260 and retainer 264 may tend to stand to the other side. In a four point embodiment (four retainers), the centroid and center of gravity may tend to lie within the quadrilateral defined by the four points, and, indeed, may tend to lie close to, or at, the centroid of that quadrilateral. As measured by the longest diagonal between any pair of the four points, the centroid of panel 222 may be within 20% of the length of that longest diagonal from the centroid of the quadrilateral. Expressed somewhat differently, if the plurality of retention points defined by the retainers and anchors define vertices of a polygon, the centroid and center of gravity, when viewed normal to the side panel lie within the boundaries of the polygon so defined. Expressed somewhat differently again, it may be said that the footprint defined by the plurality of retention points straddles the center of gravity and the centroid.

Retainers 262 and 264 may be retainers that permit a degree of freedom of motion of lifting member 252. In one embodiment, this degree of motion may be a linear or arc length degree of motion by which lifting member 252, or a portion thereof, may move in linear translation through retainer 262 or 264. That is, retainers 262 and 264 may have the form of an eyelet, or aperture, or tunnel, or prong, or fairlead, or keeper that allows relative sliding of a portion of lifting member 252 therethrough. Retainers 262 and 264 may be anchored quite sturdily to the surrounding wall structure more generally, and panel 224 may be provided with a reinforcement, such as a lateral web band 268 to provide a locally stronger load spreading member that may diffuse a tensile load at the retainer into the surrounding material which may tend to act as a membrane.

The overall running length of lifting member 252 may exceed the straight-line, crow-flies length of the three sides of the quadrilateral. Member 252 can be said to have three portions—that portion between first end 256 and first retainer 262 being identified as a first portion 270, that portion between first and second retainers 262 and 264 being identified as a second portion 272, and that portion between second retainer 264 and second end 266 being identified as a third portion 274. To the extent that member 252 has a total path length or arc length greater than the three side length, at any time at least one of the first, second, and third portions may have a path length greater than the corresponding straight-line length between the two respective retaining points bounding that portion.

Figure 12F:
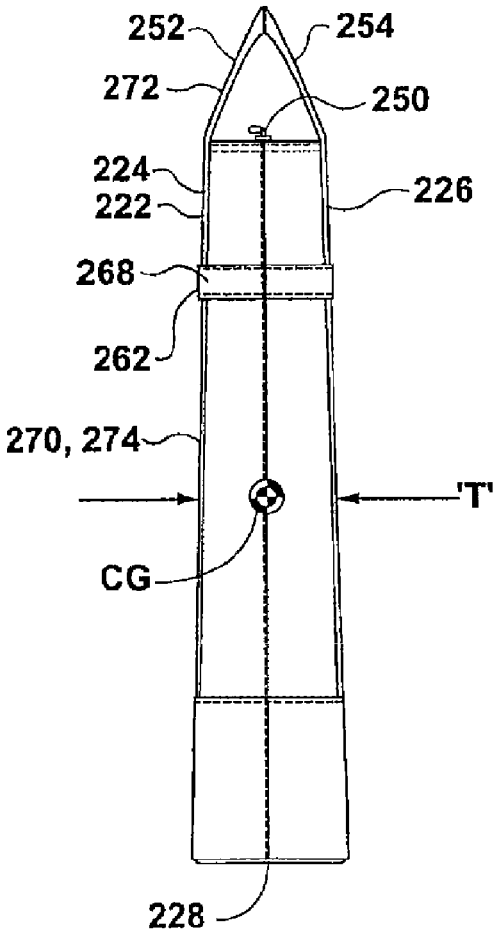
FIG. 12*f* shows a predominantly up and down position of the insulated bag of FIG. 12*f.*

It may be that the length of lifting member 252 is such that, in the predominantly upright or vertical carrying condition exemplified by FIG. 12*f*, the resultant bails of members 252 and 254 have a corresponding length, and may be grasped together in one hand. Either or both of members 252 and 254 may have a load spreader 276 at the apex either to provide softer carrying in the hand, or to go over a shoulder. In this orientation, the bight in the strap may tend to be all in second portion 272, and first and third portions 270 and 274 may tend to be drawn tight and straight as in FIG. 12*b* or 12*f*.

In the predominantly horizontal, or flat, or substantially level orientation, one, or preferably both, of first and third portions 270 and 274 may be grasped by the user, possibly in one hand, and second portion 272 may tend to be drawn tight and straight as in FIG. 12*a*. Expressed differently, when the slack in member 252 is moved to the first and third portions 270, 274, those portions may be used to lift bag 220 more generally, and when lifted by this means, may tend to cause the body of bag 220 to have a generally horizontal, or level, or predominantly flat orientation, as opposed to a predominantly up-and-down orientation.

Perhaps conveniently, bag 220 may also include a pocket, or pouch, or accommodation 280, which may be mounted on the front or top surface of panel 222, and which may, in one embodiment, be mounted generally centrally with respect thereto. Accommodation 280 may have a closure member 282, such as a tracked fastener running along one margin thereof. Accommodation 280 may be suitable for carrying papers, or cutlery or condiments such as may accompany objects transported in the main insulated enclosure space of bag 220 more generally.

Bag 220 may also include a pocket or pouch or accommodation 284, which may have a clear plastic face sheet 286. Accommodation 284 may be located generally centrally with respect to panel 222, and may be located on top of, or in front of accommodation 280. Accommodation 284 may be located between first and third portions 270 and 272, and may be generally rectangular. Accommodation 284 may have an access opening 288, which may tend to be oriented toward the main closure member 250, such that, when the bag is standing in the upright condition, access opening 288 faces generally upward. In this location, a person engaged in pizza delivery may place invoices, or the delivery sheet having the addresses of the delivery locations in accommodation 284, visible on the passenger's seat of the car when driving, and also visible when the pizza is carried to the door, and payment is received.

As such, foldable bag 220 may be an insulated bag having an insulated wall structure. The bag has a pair of strap handles (items 252, 254) by which it may be carried in a predominantly up and down orientation (FIG. 12*f*). One of the strap handles (item 252, for example,) may be re-positionable to permit said bag to be carried in a predominantly horizontal direction (FIG. 12*e*). That is, bag 220 may be considered to be a bag having an insulated wall structure, the wall structure having a width, a depth, and a thickness. The width and depth may each be more than double the thickness. The bag may have opposed sidewall portions that are extensive in directions corresponding to the width and depth. The bag has a handle that is movable between a first position in which the bag hangs in a predominantly up- and down orientation when suspended by the handle, and a second position in which the bag hangs predominantly cross-wise when suspended from the handle.

In another way of expressing this, bag 220 has an insulated sidewall, and a bail (item 252 for example) attached to the insulated sidewall. The sidewall has a first margin portion and a generally opposed second margin portion. The first portion of the bail is retained at a first retention location in a region closer to the first margin than to the second margin. A second portion of the bail is retained at a second retention location closer to the second margin than to the first margin. The handle is movable to a first position wherein, in use, the bag is suspended from a location of suspension and the first retention location is between the location of suspension and the second retention location. The handle is movable to a second retention position in which, in use, the bag is suspended from a second location of suspension, the second location of suspension being between the first and second retention locations. That is, bag 220 can be described as having an insulated sidewall and a first handle mounted to the sidewall. The handle has first and second ends attached to the sidewall, and first and second keepers through which the handle is fed, such that the handle has a first region between the first end and the first keeper, a second region between the second end and the second keeper, and a third region between the first and the second keepers. The handle is movable to a first position in which the bag is suspendable from the third region in a predominantly up-and-down orientation, and is suspendable from at least one of the first and second regions in a predominantly cross-wise orientation.

Although the embodiments illustrated and described above are preferred, the principles of the present invention are not limited to these specific examples which are given by way of illustration. Since changes in or additions to the above-described embodiments may be made without departing from the nature, spirit or scope of the invention, the invention is not to be limited to those details, but only by the appended claims.

We claim:

1. A foldable insulated bag comprising:

an insulated wall structure, defining an insulated space therewithin, said wall structure having a width, a depth and a through thickness;

said width being at least twice as great as said through thickness, said depth being at least twice as great as said through thickness, said insulated wall structure being suitable for transportation of pizza therein;

said wall structure including a first side wall panel, said first side wall panel having dimensions corresponding to said width and breadth;

said wall structure having a closure member operable to govern access to said insulated space;

said wall structure including a forming panel;

said wall structure, when empty, being movable to a first, flattened position;

said wall structure being foldable about at least a portion of said forming panel to a folded storage position;

at least one strap handle by which said bag can be carried in a predominantly up and down orientation, said strap handle being re-positionable to permit said bag to be carried in a predominantly cross-wise orientation;

an accommodation mounted generally centrally on said first side wall panel, said accommodation having a transparent face sheet, said face sheet being visible when said wall structure is placed with said first side wall panel uppermost whereby a document placed in said accommodation is visible through said face sheet while said insulated bag is in said cross-wise orientation as during pizza delivery.

2. The foldable insulated bag of claim 1 wherein said first side wall panel has a centroid, and said strap handle is retained by an array of retainers, at least one of said retainers permitting at least one degree of motion of at least a portion of said strap handle relative to said sidewall panel, and said array of retainers defines vertices of a polygon, said centroid falling within said polygon.

3. The foldable insulated bag of claim 1 wherein:

said strap handle is secured to said wall structure at a plurality of retention points, one of said retention points being defined by a keeper that permits sliding of at least a portion of said strap handle relative thereto;

in said first position, a bight is formed in said strap handle to one side of said keeper; and in said second position, a bight is formed in said strap handle to another side of said keeper.

4. The foldable insulated bag of claim 3 wherein, said sidewall structure has a largest side, said largest side has a centroid, and said plurality of retention points define a footprint that straddles said centroid.

5. The foldable insulated bag of claim 3 wherein said sidewall structure has a largest side, said largest side being said first side wall panel, said largest side has a centroid, said plurality of retention points define a footprint that straddles said centroid, and said accommodation is located centrally on said largest side.

6. The foldable insulated bag of claim 1 wherein:

said strap handle is secured to said wall structure at a plurality of retention points, two of said retention points being defined by respective first and second keepers each of which permits sliding of at least a portion of said strap handle relative thereto;

said strap handle being movable between a first position and a second position;

in said first position a bight is formed in said strap handle between said first and second keepers;

in said second position, a first bight is formed in said strap handle between said first keeper and a retention point other than that defined by said second keeper, and a second bight is formed between said second keeper and a retention point other than that defined by said first keeper;

said strap handle has a running length, said first and second bights have apices, and said length is great enough that said apices are movable to contact each other, whereby a person lifting said bag may hold both of said bights in one hand.

7. The foldable insulated bag of claim 1 wherein:

said first sidewall panel has at least a first margin;

said closure member running along at least a portion of said wall structure adjacent to that first margin;

said strap handle is restrained at first and second retention points on said sidewall panel distant from said first margin, and at third and fourth retention points on said sidewall panel more proximate to said first margin than are said first and second retention points;

said strap handle includes a flexible member running from said first retention point to said third retention point, from said third retention point to said fourth retention point, and from said fourth retention point to said second retention point;

in said first position said strap handle has a bight located between said third and fourth retention points, said bight being of size to extend beyond said first margin; and in said second position said strap handle has a bight located between at least one of (a) said first retention point and said third retention point; and (b) said second retention point and said fourth retention point.

8. The foldable insulated bag of claim 7 wherein said third and fourth retention points are keepers and said strap handle is at least partially slidable with respect thereto.

9. The foldable insulated bag of claim 1 wherein said bag is a double fold bag.

10. The foldable insulated bag of claim 1 wherein said forming panel has a flexural rigidity greater than any other portion of said bag, said forming panel including a pair of spaced apart, parallel, stiffened straight edges.

11. The foldable insulated bag of claim 1 wherein said insulated wall structure includes a base panel and a sidewall structure mounted about said base panel, said forming panel being said base panel.

12. The foldable insulated bag of claim 11 wherein:

said sidewall structure includes first and second opposed sidewall panels, each said sidewall panel having a first edge adjoining said base panel and a second edge distant therefrom;

said base panel is rectangular, having two opposed sides of length 'b' and two opposed sides of length 'a';

said first edge of said first sidewall panel has a length, L; and said length L being at least as great as b+2a.

13. The foldable insulated bag of claim 11 wherein said sidewall structure includes a second sidewall panel, said first and second sidewall panels being of equal size, each side wall panel having a first edge adjoining said base panel and a second edge distant therefrom; and each of said first and second sidewall panels having third and fourth edges those respective third edges being joined together and those respective fourth edges being joined together.

14. The foldable insulated bag of claim 1 wherein:

said strap handle includes a strap having a first end anchored to said first side wall panel at a first location, and a second end anchored to said first sidewall panel at a second location;

said bag has a first keeper mounted to said first side wall panel at a third location, and a second keeper mounted to said second sidewall panel at a fourth location, said strap being fed through said first and second keepers, and being able slidably to move through said keepers;

said third and fourth locations are closer to said closure member than are said first and second locations;

a first portion of said strap runs between said first location and said first keeper;

a second portion of said strap runs between said second portion and said second keeper; and said accommodation is mounted between said first and second portions of said strap.

15. The foldable insulated bag of claim 1 wherein:

said strap handle includes a strap having a first end anchored to said first side wall panel at a first location, and a second end anchored to said first sidewall panel at a second location;

said bag has a first keeper mounted to said first side wall panel at a third location, and a second keeper mounted to said second sidewall panel at a fourth location, said strap being fed through said first and second keepers, and being able slidably to move through said keepers;

said third and fourth locations are closer to said closure member than are said first and second locations; and said bag has a reinforcement mounted thereacross to spread loads from said first and second keepers into said first web panel.

16. The foldable insulated bag of claim 15 wherein:

said bag has a width, L, a depth, D, and a through thickness, T, a ratio of L:D lies in the range of 2:3 to 3:2, a ratio of L:T lies in the range of 5:2 to 6:1, and a ratio of D:T lies in the range of 5:2 to 6:1, whereby said foldable insulated bag has proportions suited to pizza delivery.

17. The foldable insulated bag of claim 16 wherein, in said up-and-down orientation said insulated bag has an uppermost side; said closure member is mounted to run along said uppermost side; said accommodation has an access opening; and when said bag is standing in said up-and-down orientation said access opening faces upward.

18. A foldable insulated bag comprising:

an insulated wall structure, defining an insulated space therewithin;

said wall structure having a closure member operable to govern access to said insulated space; and said wall structure including a first sidewall panel and a forming panel;

said wall structure, when empty, being movable to a first, flattened position;

said wall structure being foldable about at least a portion of said forming panel to a folded storage position;

at least a first handle member mounted to said wall structure;

said handle member having first and second ends attached to said wall structure at first and second locations on said first sidewall panel;

first and second keepers mounted to said wall structure at third and fourth locations on said first side wall panel;

said first sidewall panel having a centroid;

first, second, third and fourth locations defining vertices of a rectangle, said centroid being located within said rectangle;

an accommodation for documents mounted to said first side wall panel within said rectangle, said accommodation having a transparent face sheet though which documents placed within said accommodation can be seen;

said handle member being slidable with respect to said first and second keepers, and being threaded through said first and second keepers;

said handle member having a first region between said first end and said first keeper, a second region between said second end and said second keeper, and a third region between said first and said second keepers;

said handle member being movable to form a bight in said third region from which said bag is suspendable in a predominantly up-and-down orientation, and said handle member being movable to form bights in said first and second regions, said bag being suspendable therefrom in a predominantly cross-wise orientation.

19. The foldable insulated bag of claim 18 wherein said bag has a width, L, a depth, D, and a through thickness, T, a ratio of L:D lies in the range of 2:3 to 3:2, a ratio of L:T lies in the range of 5:2 to 6:1, and a ratio of D:T lies in the range of 5:2 to 6:1, whereby said foldable insulated bag has proportions suited to pizza delivery.

20. The foldable insulated bag of claim 19 wherein:

in said up-and-down orientation said insulated bag has an uppermost side;

said closure member runs along said uppermost side;

said accommodation has an access opening; and when said bag is standing in said up-and-down orientation said access opening faces upward.

* * * * *